US007249676B2

(12) United States Patent
Wang

(10) Patent No.: US 7,249,676 B2
(45) Date of Patent: Jul. 31, 2007

(54) PACKAGING, STORAGE AND DISPLAY APPARATUS AND SYSTEM

(75) Inventor: Yuhong Wang, Shanghai (CN)

(73) Assignee: TG Tools United Company, St. Charles, IL (US)

( * ) Notice: Subject to any disclaimer, the term of this patent is extended or adjusted under 35 U.S.C. 154(b) by 0 days.

(21) Appl. No.: 11/523,984

(22) Filed: Sep. 20, 2006

(65) Prior Publication Data

US 2007/0012587 A1 Jan. 18, 2007

Related U.S. Application Data

(63) Continuation-in-part of application No. 10/636,972, filed on Aug. 7, 2003, now abandoned, and a continuation-in-part of application No. 10/984,509, filed on Nov. 9, 2004, now abandoned, and a continuation-in-part of application No. 11/004,051, filed on Dec. 3, 2004, now abandoned.

(51) Int. Cl.
*B65D 85/20* (2006.01)

(52) U.S. Cl. ..... 206/747; 206/749; 206/762; 206/764; 206/372; 206/379

(58) Field of Classification Search ..... 206/368–379, 206/756, 759, 762–765, 747–749, 45, 24
See application file for complete search history.

(56) References Cited

U.S. PATENT DOCUMENTS 1,043,891 A * 11/1912 Zange ..... 206/379
3,578,153 A * 5/1971 Olson ..... 206/379
4,764,955 A * 8/1988 Galand et al. ..... 379/406.1
5,006,066 A * 4/1991 Rouse ..... 433/77
5,312,250 A * 5/1994 Ellman et al. ..... 433/77
5,570,784 A * 11/1996 Sidabras et al. ..... 206/378
6,263,543 B1 * 7/2001 Daoud ..... 16/342
6,283,291 B1 * 9/2001 Vasudeva et al. ..... 206/373

OTHER PUBLICATIONS

Mibro Metal Drill Bit package, on sale at least as early as Aug. 6, 2002.
Plastic clamshell drill bit package, on sale at least as early as Aug. 6, 2002.
Interchangeable drill bit index, on sale at least as early as Aug. 6, 2002.

(Continued)

*Primary Examiner*—Mickey Yu
*Assistant Examiner*—Jerrold Johnson
(74) *Attorney, Agent, or Firm*—Greenberg Traurig

(57) ABSTRACT

The present invention is directed to a packaging, storage and display system for articles, such as small tools, like drill bits and the like. An index for holding the articles is pivotably mounted in a case. A rack, which may be selected from a variety of rack structures, is mounted within the index, for holding articles having particular sizes and shapes. A frame structure is resistively pivotably mounted on the index, so that the frame structure may be pivoted to a particular position relative to the index, and will tend to remain in that position, until a force in excess of a particular amount is exerted on the frame structure. The index and/or the frame structures may be interchangeably mounted.

17 Claims, 42 Drawing Sheets

OTHER PUBLICATIONS

Clamshell drill package with snap-in pivotable indices, on sale at least as early as Aug. 6, 2002.

Clamshell drill package with tip-out drill bit indices, on sale at least as early as Aug. 6, 2002.

Clamshell ratchet tool kit, with arcuate, snap-in, pivotable indices, on sale at least as early as Aug. 6, 2002.

Clamshell drill package, with fitted, snap-in, indicies, on sale at least as early as Aug. 6, 2002.

DeWalt drill package, with molded plastic fixes position inserts for holding bits, on sale at least as early as Aug. 6, 2002.

Meal bottom-hinged drill box, with a metal, permanently installed index, hinged to both base and cover to be raised automatically upon opening of the lid, on sale at least as early as Aug. 6, 2002.

Skil plastic clamshell drill box, with pivotable rubber indices, on sale at least as early as Aug. 6, 2002.

Plastic bottom-hinged drill box, with pivotable index, interconnected to lid, to be raised when lid is opened, on sale at least as early as Aug. 6, 2002.

Plastic bottom-hinged drill box, with index pivotably mounted In base, and lid pivotably mounted on Index, on sale at least as early as Aug. 6, 2002.

* cited by examiner

PACKAGING, STORAGE AND DISPLAY APPARATUS AND SYSTEM

This application is a continuation-in-part of, and claims the priority of the filing dates of: Ser. No. 10/636,972, filed Aug. 7, 2003; Ser. No. 10/984,509, filed Nov. 9, 2004; and Ser. No. 11/004,051, filed Dec. 3, 2004, the complete disclosures of each of which are hereby specifically incorporated by reference herein. All are abandoned.

STATEMENT REGARDING FEDERALLY SPONSORED RESEARCH OR DEVELOPMENT

NOT APPLICABLE

REFERENCE TO A SEQUENCE LISTING, TABLE OR COMPUTER PROGRAM LISTING

NOT APPLICABLE

BACKGROUND OF THE INVENTION

1. The Technical Field

The present invention is directed to packaging, storage and display devices, such as are used for containing articles such as drill bits (for example, high speed, masonry, wood, general use bits, etc.), driver bits, other power tool and hand tool accessories and the like.

2. The Prior Art

Containers for packaging, storage and display of tools, particularly small tool items, such as drill bits, saw blades, bolt- and screwdriver bits, sockets and the like are known.

Some such containers are formed as a hinged plastic or metal two-piece hinged case, that is held closed by a resilient plastic or metal latch that is simply bent back to release a detent, and permit the two parts of the two-piece hinged case to be pivoted away from one another, to open like a book. The parts of the two-piece hinged case may have approximately the same dimensions, but be formed as essentially mirror images of each other, except for the latch structure.

In each part of the two-piece hinged case, positions for holding parts, e.g., drill bits, may be formed directly into the inner surfaces, in the form of pairs of prongs that are spaced apart and sized, so that each part position is formed to hold a specific drill bit (or other part) having a specific diameter or nominal size. That is, a bit of a particular size is pressed between the respective prongs (usually concave toward one another) of the respective pairs and snap-fitted in. Alternatively, elongated slots of different lengths and widths may be formed directly into the inside surfaces of the two-piece hinged case parts.

Alternatively, instead of forming prongs or slots directly into the inside surfaces of the two-piece hinged case parts, molded or stamped non-moving inserts that have specifically sized slots formed in them, may be positioned into the interior spaces of the two-piece hinged case parts. One such drill bit holder is sold by DeWalt® under the name New Guaranteed Tough™ Case.

In more complex versions, a bar or block (usually called an "index") may be fitted into the bottom portion of one or both parts of the two-piece hinged case. The index may have a number of blind bores or combinations of bores and aligned slots formed into it, again having different diameters, and possibly different depths as well, to receive tool parts (e.g., drill bits) of different size.

The index is often formed as a single piece that may be blow or injection molded (if plastic) or stamped (if made of thin metal). Often, the sizes (or other information) of the tools that are to be held in the index are printed or stamped into the front or back of the index, lined up with the locations of the respective tools.

The index may be fixed in place, such as by gluing or welding, simple friction or snap-fit. In some prior art tool bit holders, the index is provided at the opposite ends with male or female dovetail components that interfit with counterpart female or male dovetail components formed into the inside surfaces of the side walls of the two-piece hinged case part. One such drill bit holder is made and sold by Blu-Mol under the mark "Armor-Case".

In these three types of cases, the cases are fixed both in the sense that only specifically sized bits can be held in the cases, and in the sense that because the indexes (if provided) do not move, there is some limitation to the accessibility of the tool bits.

Alternatively the index may be provided with bumps that project from the ends of the index, that are received, e.g., in a snap-fit manner, in corresponding recesses, bores or slots formed in the inside walls of the two-piece hinged case part. In some prior art embodiments, the index must be bent or deformed in order to fit into the receiving recesses, bores or slots. These recesses, bores or slots may be provided in one or a number of pairs, so that the index may be placed at various locations along the "height" of the two-piece hinged case part. This permits the bar or index to be pivoted, relative to the two-piece hinged case part, so that the access to the parts is improved. Additional, smaller resilient projections may be provided to act as detents to hold the bars in place in their recessed positions. Pivoting of the bars out of their recessed positions thus requires some small effort to overcome the frictional or interference resistance of the smaller resilient projections. One such case is made and sold under the Skil® trademark.

In other prior art embodiments, the index, in addition to being configured to pivot, may be formed as a two-piece construction. One portion of the index engages, in a snap-fit manner, to the inside surface of the two-piece hinged case part, and is pivotably connected to the other portion of the index which pivots upwardly and out of the plane of the two-piece hinged case part. One example of such a case is made for and sold by Sears® under the Craftsman® mark, with the particular index construction being marketed under the mark Speed-Dex™. In this construction, the front area of the index that faces the user is open, so that there is no room for indicia in front of each bore, to indicate the bit sizes. In this product, the holder of the pivoting portion of the index must be glued in place, against the inside surfaces of the case part.

In the previously-mentioned case made and sold under the Skil® trademark, the index is formed from two pieces of a molded rubber or rubber-like material. One piece has a U-shaped cross-section, that forms the front, bottom and rear of the index. The second piece is a mostly solid wedge-shaped block, that is insertingly received and molded, glued or welded into the first piece, and has apertures formed in it to receive the shanks of the tool pieces.

In other kinds of tool part holders, the case may be formed again as a two-piece hinged case, but with the hinge located at the bottom of the case. One portion of the case is often larger or has more depth than the other portion. One of the portions may include a hole at the top, to permit the case to be hung from a hook, such as on a store shelf or in a workshop. These cases may also be fabricated from metal, plastic or a combination of metal and plastic.

Such bottom-hinged cases usually include an index that is pivotably connected to both parts, often using the axis of pivoting of the two parts also as the axis of pivoting for the index, and held in place by wire and metal rivets. In some of these prior art constructions, there may be provided detents or ridges on one or both of one of the case parts and the index. Upon opening of the case, once the two parts have been pivoted away from one another by a certain angle or amount, the index is forced or at least prompted to pivot away from one or both case parts. This results in the index being moved to an angular position somewhere between the two case parts. Alternatively, a hook or wire may connect one of the case parts to the index, to both prompt movement of the index and hold the index in place once the case has been opened. Such cases are used to package and sell drill bits sold by MIBRO®.

These cases can exhibit certain characteristics that may make them less than optimal, such as that in some prior art cases having indexes that are not positively affixed, the indexes can fall out when the cases are opened. In some of the two-piece hinged case (book-opening style) cases, the indexes may be configured to pivot, but once out of their recessed positions, there is nothing to hold the index in its elevated position, so that the index tends to fall back into the case part from which it has been pivoted. Alternately, in the bottom hinged cases, the interlocking of the index to the movements of the case parts constrains the movement and positioning of the index to a single specific position, when the case has been opened to its in-use position.

It would be desirable to provide a packaging, storage and display case for holding small tool parts, that is capable of adaptation to accommodate different combinations of tools of different sizes.

It would also be desirable to provide a packaging, storage and display case for holding small parts, that is provided with an index that is capable of being moved to a variety of different positions, and held in any such different position.

It would also be desirable to provide a packaging, storage and display case for holding small parts, that is provided with an index that can be moved between stowed and deployed positions repeatedly, while reliably maintaining the selected stowed positions.

It would be desirable to provide a system of packaging, storage and display components that provides for enhanced flexibility in packaging and storage of individual tool parts.

These and other desirable characteristics of the present invention will become apparent in view of the present specification, including claims, and drawings.

SUMMARY OF THE INVENTION

The present invention comprises in part a holder for packaging, storing and displaying articles, comprising an index having positioned therewithin a rack which is operably configured to engage and releasably retain an end of at least one article; a frame structure pivotably mounted to the index; and rotation control structure interconnecting the frame structure and the index, for providing resistance to relative rotation between the frame structure and the index, until a torsional force between the frame structure and the index is applied, which is in excess of a predetermined amount of torsional force, whereupon relative pivoting to is enabled, and whereupon removal of the torsional force, which is in excess of a predetermined amount of torsional force, the frame structure and the index will remain in position relative to each other. Preferably, the at least one index comprises a first index cover part having interior structures therein configured for guiding and receiving the rack. A second index cover part is preferably configured to matingly join the first index cover part to capture the rack between the first index cover part and the second index cover part.

The frame structure preferably comprises a web of material, one end of which is connected to and extends from one end of the at least one index for a predetermined distance, across the width of the at least one index and proceeds at the other end of the web, to the other end of the index, to form a loop which encloses a defined space between the frame structure and the index, within which the articles received by the index are to be positioned.

Preferably, the frame structure is selected from a plurality of frame structures having different shapes and configurations for defining different shapes and areas of spaces between the webs of the frame structures and the index, when each of the frame structures is mounted on the index. Preferably, the frame structure includes at least one surface which engages with a corresponding mating surface of the at least one index, and the rotation control structure comprises mating ratchet structures disposed on the at least one surface of the frame structure and the corresponding mating surface of the at least one index.

The present invention also comprises, in part, a packaging, storage and display apparatus for articles, comprising a case having at least one case section that defines an interior volume for receiving articles, with at least one index pivotably mounted in the at least one case section, the at least one index being pivotably movable between a stowed position within the at least one case section, and a deployed position. The at least one index is preferably operably configured to receive and retain an end of at least one article. A frame structure is preferably pivotably mounted to the index, and rotation control structure preferably interconnects the frame structure and the index, and is operably configured to enable at least one portion of the frame structure to remain in a first position relative to the index until a force greater than a predetermined amount is applied, prompting the at least one portion of the frame structure to move to one of a plurality of possible second positions relative to the index, and to further enable the at least one portion of the frame structure to remain in the one of a plurality of second positions upon removal of the force, wherein the frame structure includes at least one surface which engages with a corresponding mating surface of the at least one index, and the rotation control structure comprises mating ratchet structures disposed on the at least one surface of the frame structure and the corresponding mating surface of the at least one index.

The frame structure is further preferably operably configured to inhibit removal of the at least one article from the at least one index when the at least one portion of the frame structure is in the first position, the frame structure being further operably configured to provide support to the at least one index when the at least one index is in the deployed position, and the at least one portion of the frame structure is in one of the plurality of possible second positions.

The rotation control structure preferably comprises at least one male ratchet member, disposed on one of the frame structure and the index, and having an first axis of pivoting, and a projecting contoured portion with contoured ratchet surfaces disposed circumferentially about the first axis of pivoting on a radially outwardly facing surface of the projecting contoured portion; and at least one female ratchet member, disposed on the other of the frame structure and the index, and having a second axis of pivoting, and a recess centered on the axis of pivoting, and a plurality of complementary contoured ratchet surfaces disposed circumferentially about the second axis of pivoting on a radially inwardly facing surface of the recess. The at least one first male ratchet member is preferably insertably received in the at least one female ratchet member, the first axis of pivoting being disposed coaxially with the second axis of pivoting. The contoured ratchet surfaces of the male ratchet member may comprise a plurality of convex projections. The plurality of complementary contoured ratchet surfaces of the female ratchet member may comprise a plurality of concavities. Alternatively, the contoured ratchet surfaces of the male ratchet member may comprise a plurality of concavities, and the plurality of complementary contoured ratchet surfaces of the female ratchet member may comprise a plurality of convex projections. The plurality of complementary contoured ratchet surfaces of the female ratchet member and the contoured ratchet surfaces of the male ratchet member may comprise complementary sets of radially extending projections.

The present invention also comprises, in part, a packaging, storage and display apparatus for articles, comprising a case having at least one case section that defines an interior volume for receiving articles. At least one index is preferably pivotably mounted in the at least one case section, the at least one index being pivotably movable between a stowed position within the at least one case section, and a deployed position. The at least one index is preferably operably configured to receive and retain an end of at least one article. A frame structure is pivotably mounted to the index. The frame structure is preferably operably configured to inhibit removal of the at least one article from the at least one index when the at least one portion of the frame structure is in a first position, the frame structure being further operably configured to provide support to the at least one index when the at least one index is in the deployed position, and the at least one portion of the frame structure is in one of a plurality of possible second positions. At least one retaining pin is preferably operably positioned in the at least one case section, for releasably engaging and retaining at least one of the frame structure and the at least one index when the at least one index is disposed in its stowed position.

The at least one retaining pin preferably comprises a central post, having a retaining arm extending laterally therefrom, with at least one flexible side leg, extending substantially parallel to the central post, and connected thereto by a transverse web, and at least one tooth, extending laterally from the at least one flexible leg, for frictionally engaging an inside surface of a retaining pin receiving aperture disposed in the at least one case section.

The present invention also further comprises a packaging, storage and display apparatus for articles, comprising a case having at least one case section that defines an interior volume for receiving articles, with at least one index pivotably mounted in the at least one case section, the at least one index being pivotably movable between a stowed position within the at least one case section, and a deployed position. The at least one index is preferably operably configured to receive and retain an end of at least one article. A frame structure is pivotably mounted to the index, with rotation control structure interconnecting the frame structure and the index, operably configured to enable at least one portion of the frame structure to remain in a first position relative to the index until a force greater than a predetermined amount is applied, prompting the at least one portion of the frame structure to move to one of a plurality of possible second positions relative to the index, and to further enable the at least one portion of the frame structure to remain in the one of a plurality of second positions upon removal of the force, wherein the frame structure includes at least one surface which engages with a corresponding mating surface of the at least one index, and the rotation control structure comprises mating ratchet structures disposed on the at least one surface of the frame structure and the corresponding mating surface of the at least one index. The frame structure is operably configured to inhibit removal of the at least one article from the at least one index when the at least one portion of the frame structure is in the first position, the frame structure being further operably configured to provide support to the at least one index when the at least one index is in the deployed position, and the at least one portion of the frame structure is in one of the plurality of possible second positions.

The rotation control structure comprises preferably comprises at least one male ratchet member disposed on one of the frame structure and the index, and having an first axis of pivoting, and a projecting contoured portion with at least one contoured ratchet surface disposed perpendicular to the first axis of pivoting on a radially outwardly facing surface of the projecting contoured portion, with at least one female ratchet member disposed on the other of the frame structure and the index, and having a second axis of pivoting, and a recess centered on the axis of pivoting, and a plurality of complementary contoured ratchet surfaces disposed circumferentially about the second axis of pivoting on a radially inwardly facing surface of the recess. The at least one first male ratchet member is insertably received in the at least one female ratchet member, the first axis of pivoting being disposed coaxially with the second axis of pivoting.

The at least one contoured ratchet surface of the male ratchet member may comprise a generally triangular projection. The plurality of complementary contoured ratchet surfaces of the female ratchet member may comprise a plurality of concavities. The at least one contoured ratchet surface disposed perpendicular to the first axis of pivoting on a radially outwardly facing surface of the projecting contoured portion may comprise two contoured ratchet surfaces disposed at opposing positions, on opposed outwardly facing surfaces of the projecting contoured portion. The two contoured ratchet surfaces may comprise two triangular radially outwardly extending projections.

The present invention also comprises in part a holder for packaging, storing and displaying articles, comprising, in turn, an index having positioned therewithin a rack which is operably configured to engage and releasably retain an end of at least one article; and a frame structure pivotably mounted to the index. The frame structure is preferably operably configured to inhibit removal of the at least one article from the index when at least one portion of the frame structure is in a first position relative to the index, the frame structure being further operably configured to provide support to the index in a raised position when the at least one portion of the frame structure is in one of a plurality of possible second positions.

Rotation control structure interconnects the frame structure and the index for providing resistance to relative rotation between the frame structure and the index until a torsional force between the frame structure and the index is applied which is in excess of a predetermined amount of torsional force, whereupon relative pivoting is enabled, and whereupon removal of the torsional force, in excess of a predetermined amount of torsional force, the frame structure and the index will remain in position relative to each other. The rotation control structure may comprise at least one male ratchet member disposed on one of the frame structure and the index, and having an first axis of pivoting, and a projecting contoured portion with at least one contoured ratchet surface disposed perpendicular to the first axis of pivoting on a radially outwardly facing surface of the projecting contoured portion, and at least one female ratchet member disposed on the other of the frame structure and the index, and having a second axis of pivoting, and a recess centered on the axis of pivoting, and a plurality of complementary contoured ratchet surfaces disposed circumferentially about the second axis of pivoting on a radially inwardly facing surface of the recess. The at least one first male ratchet member is insertably received in the at least one female ratchet member, the first axis of pivoting being disposed coaxially with the second axis of pivoting.

The at least one contoured ratchet surface of the male ratchet member may comprise a generally triangular projection. The plurality of complementary contoured ratchet surfaces of the female ratchet member may comprise a plurality of concavities. The at least one contoured ratchet surface disposed perpendicular to the first axis of pivoting on a radially outwardly facing surface of the projecting contoured portion may comprise two contoured ratchet surfaces disposed at opposing positions, on opposed outwardly facing surfaces of the projecting contoured portion. The two contoured ratchet surfaces may comprise two triangular radially outwardly extending projections.

The present invention also comprises in part a packaging, storage and display apparatus for articles, comprising in turn a case having at least one case section that defines an interior volume for receiving articles, with at least one index pivotably mounted in the at least one case section, the at least one index being pivotably movable between a stowed position within the at least one case section, and a deployed position. The at least one index is operably configured to receive and retain an end of at least one article. A frame structure is pivotably mounted to the at least one index. The frame structure is operably configured to inhibit removal of the at least one article from the at least one index when at least one portion of the frame structure is in a first position relative to the at least one index, the frame structure being further operably configured to provide support to the at least one index in a raised position when the at least one portion of the frame structure is in one of a plurality of possible second positions. At least one retaining pin is operably positioned in the at least one case section for releasably engaging and retaining at least one of the frame structure and the at least one index when the at least one index is disposed in its stowed position.

The at least one retaining pin comprises a post operably configured to be received in a cooperatively configured slot in the case, with a retaining arm pivotably mounted to the post. The post includes a pin extending upwardly therefrom, having a rectangular cross-sectional configuration, and wherein the retaining arm includes a rectangular slot extending therethrough, a resiliently deformable leg forming one edge of the slot, so that upon receipt of the pin in the slot, the retaining arm is configured to be resistively pivotable around the pin, between at least two positions disposed at least 90° from one another.

The present invention further comprises in part a packaging, storage and display apparatus for articles, comprising, in turn, a case having at least one case section that defines an interior volume for receiving articles, with at least one index pivotably mounted in the at least one case section, the at least one index being pivotably movable between a stowed position within the at least one case section, and a deployed position. The at least one index is operably configured to receive and retain an end of at least one article. A frame structure is pivotably mounted to the index. The frame structure is operably configured to inhibit removal of the at least one article from the at least one index when at least one portion of the frame structure is in a first position relative to the index, the frame structure being further operably configured to provide support to the index in a raised position when the at least one portion of the frame structure is in one of a plurality of possible second positions. Structure for rotatably mounting the at least one index within the at least one case section is provided, including apertures disposed in opposing ends of the at least one index, and pivot pins operably configured to be insertingly received and retained within the apertures, with structures within the at least one case section defining opposed slots for receiving the pivot pins, and enabling manual removal of the pivot pins from the opposed slots. Each of the pivot pins includes a post operably configured to be frictionally received in one of the slots; a stem configured to be received in one of the apertures for enabling the index to be pivoted about the stem, and a head mounted on the stem and configured to be received in the index, and having a width greater than a width of a corresponding aperture for enabling the head to be retained in the index.

DETAILED DESCRIPTION OF THE INVENTION

Figure 1:
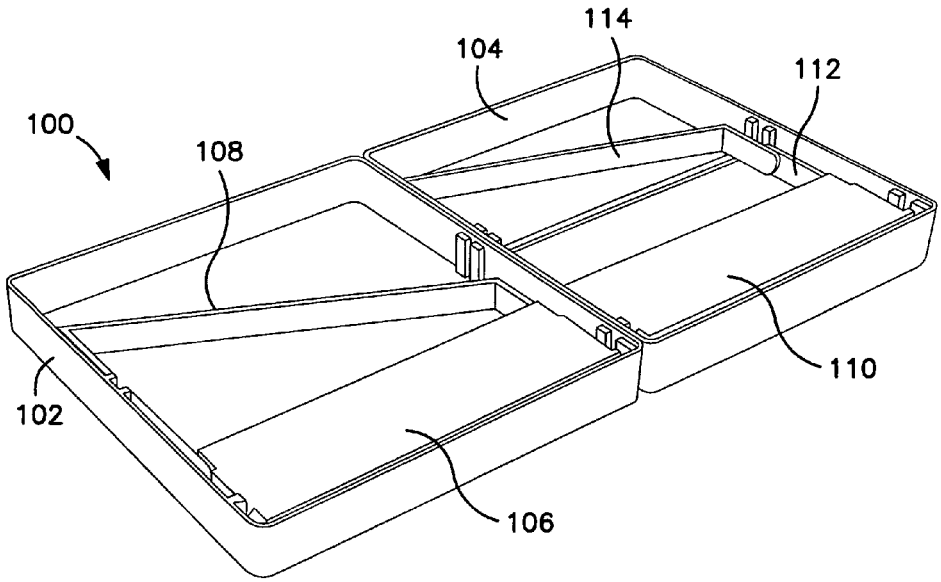
FIG. 1 is a perspective view of a packaging, storage and display case according to one example of the present invention.

While this invention is susceptible of embodiment in many different forms, there are shown in the drawings and will be described in detail several specific embodiments, with the understanding that the present disclosure is to be considered an exemplification of the principles of the invention and is not intended to limit the invention to the embodiments illustrated.

While the packaging, shipping and display cases of the present invention may preferably be formed from plastic materials, formed by any suitable method such as injection- or blow-molding, it is to be understood that any suitable materials may be used, such as thin, resilient metal.

Any numerical values or dimensions, or indications of color or surface finish that may be provided in the drawings are given merely by way of example, and the invention is not intended to be limited in any way by such indicia.

FIG. 1 is a perspective view of a packaging, shipping and display case ("tool case" for short) 100 in accordance with the principles of the present invention. Tool case 100 includes two-piece hinged case parts 102 and 104, with index 106 with frame part 108, and index 110 with frame parts 112 and 114.

As mentioned elsewhere herein, while a preferred embodiment of the invention is discussed in the environment of a conventional two-piece hinged case for holding drill bits, it is to be understood that the particular shape of the case, in which the actual tool-holding components are mounted, is not crucial, and the invention is not intended to be limited by the shape, size or configuration of the case, apart from the fact that the interior surfaces of the case need to have the mounting structures discussed herein, and as shown in FIGS. 36-41, for example.

Figure 2:
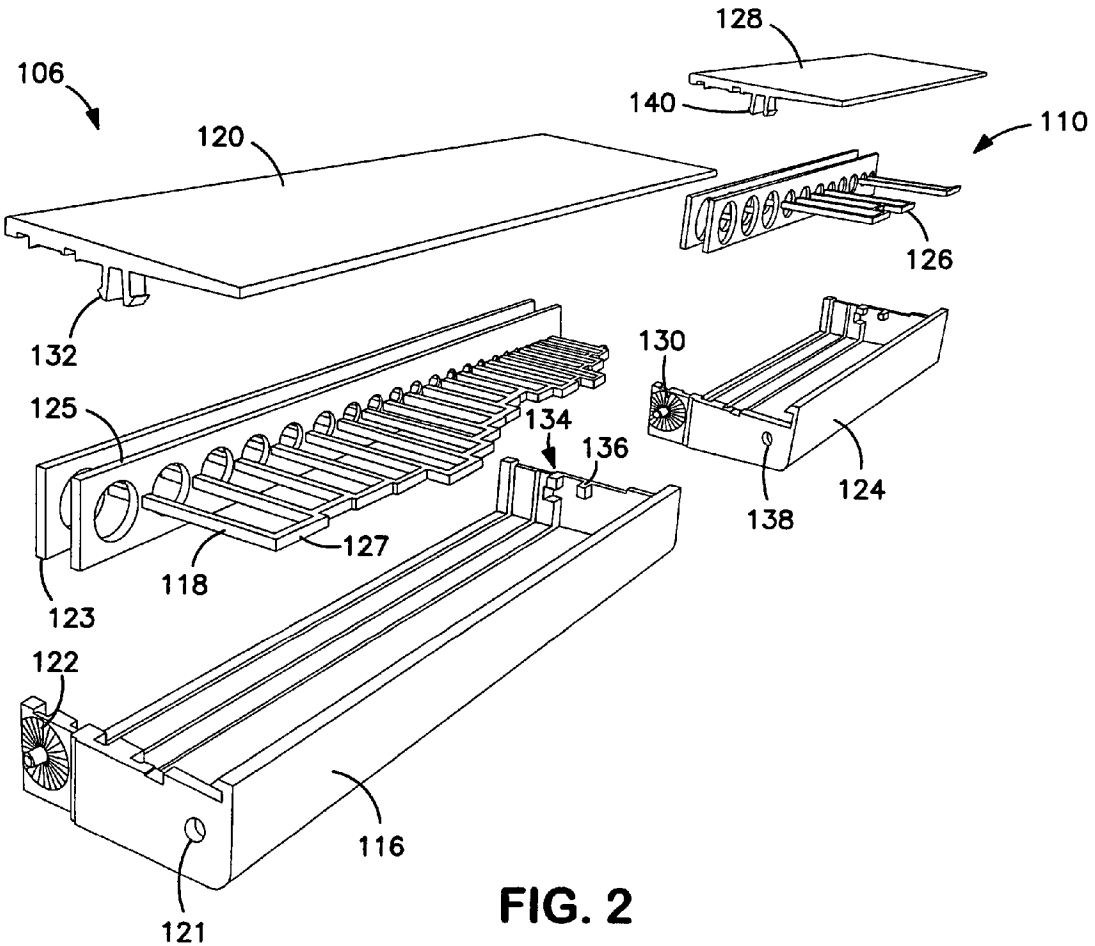
FIG. 2. is a perspective view of two indexes, in exploded views, for use in the case of FIG. 1.

FIG. 2 illustrates perspective exploded views of indexes 106 and 110, which may be identical (as illustrated in this application), but which may have some structural differences (not relating to the principles of the present invention), as dictated by the requirements of any particular application. Index 106 includes index cover part 116, rack 118, and index cover part 120. Index cover part 116 has formed thereon ratchet structure 122 (to be described in further detail herein), with a similar structure located at the opposite end of index cover part 116. Rack 118, the structure of which will be discussed in greater detail herein, is preferably insertably received in index cover part 116, in slots that run along the inner surface of index cover part 116, from one side to the other (as shown on the inside of index cover part 124), or alternatively just in the inside surfaces of the sides (not shown). Index cover part 116 and index cover part 120 are preferably held together with a snap-fit, as may be accomplished by resilient barbs 130, preferably located on both ends of the inside surface of index cover part 120, which may be configured to engage pegs 134, 136. Index cover part 118 also includes openings 121 at opposite ends.

Rack 118 is formed as two parallel "horizontal" webs 123, 125 that are connected by one or more "vertical" webs (not shown in FIG. 2). A plurality of apertures of various diameters are formed in the webs, with the diameters of the apertures in web 123 having like sized counterparts in web 125. In addition, stirrup structures (e.g., stirrup 127) may be provided, so that the tools (e.g., drill bits) do not "bottom out" in index 106, but are instead elevated above the bottom of index 106, for the purpose, for example of causing the top ends of the tools to present a particular desired profile.

Alternative rack structures having various configurations may be provided, including various stirrup structures, and apertures of different size and shape, including round and triangular (though other shapes are contemplated).

Index 110 includes index cover part 124, rack 126 and index cover part 128. Ratchet structure 130 is preferably located at both ends of index cover part 124, as are openings 138. Rack 126 is likewise insertably received in index cover part 124, in suitably formed slots on the inside surface thereof. Index cover part 128 is preferably joined to index cover part 124 by barbs 140 that engage pegs positioned similarly to pegs 134, 136.

Figure 3:
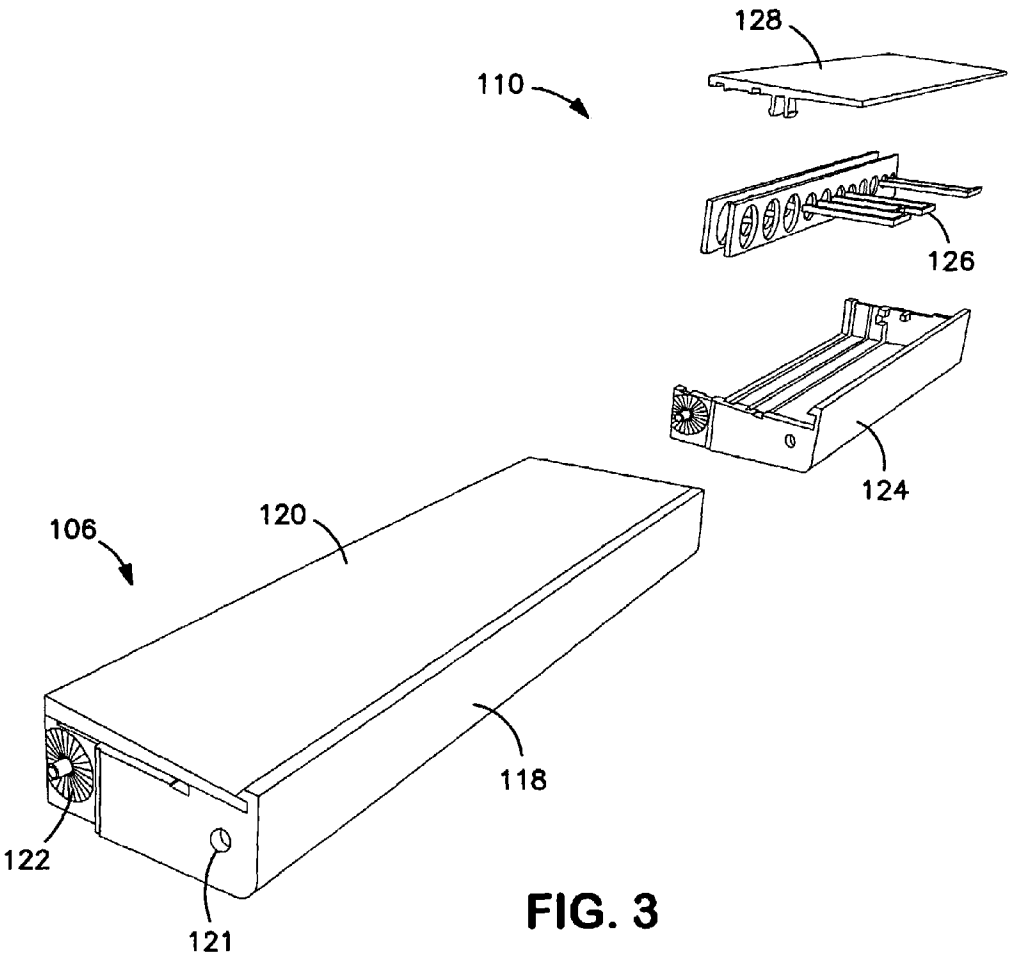
FIG. 3 is a perspective view of the indexes of FIG. 2, showing one index in assembled form, the other in exploded form.
Figure 4:
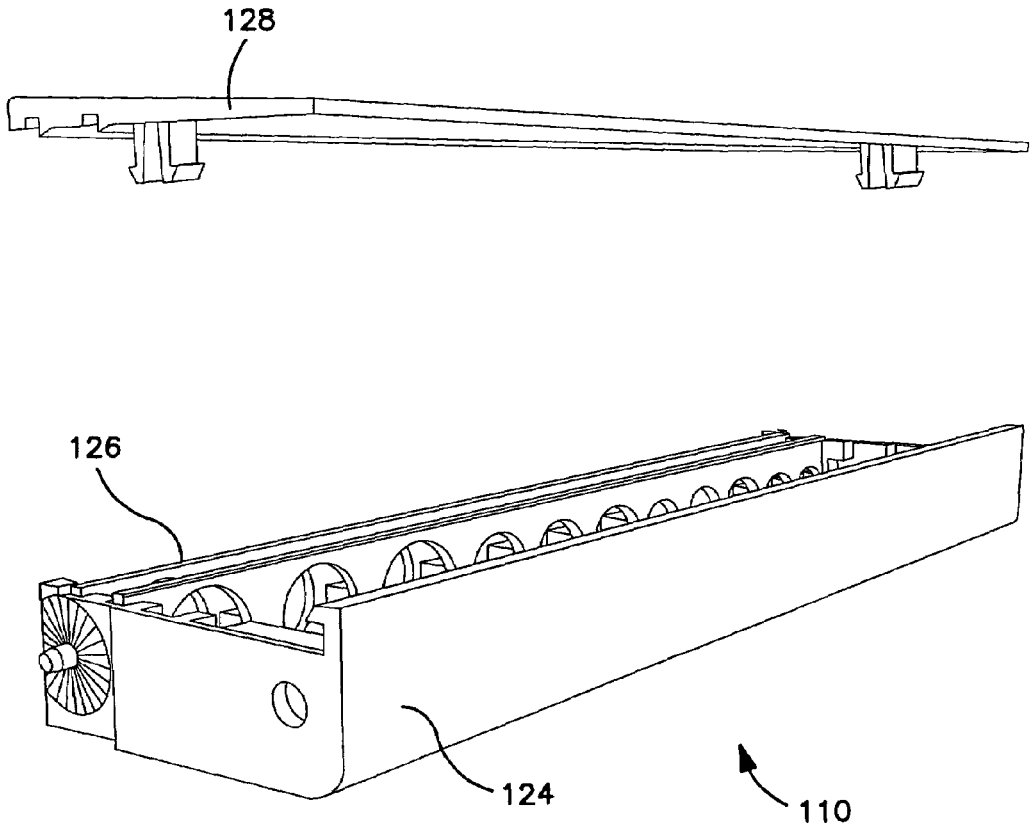
FIG. 4 is a view of an index of FIG. 2 in the final stage of assembly.
Figure 5:
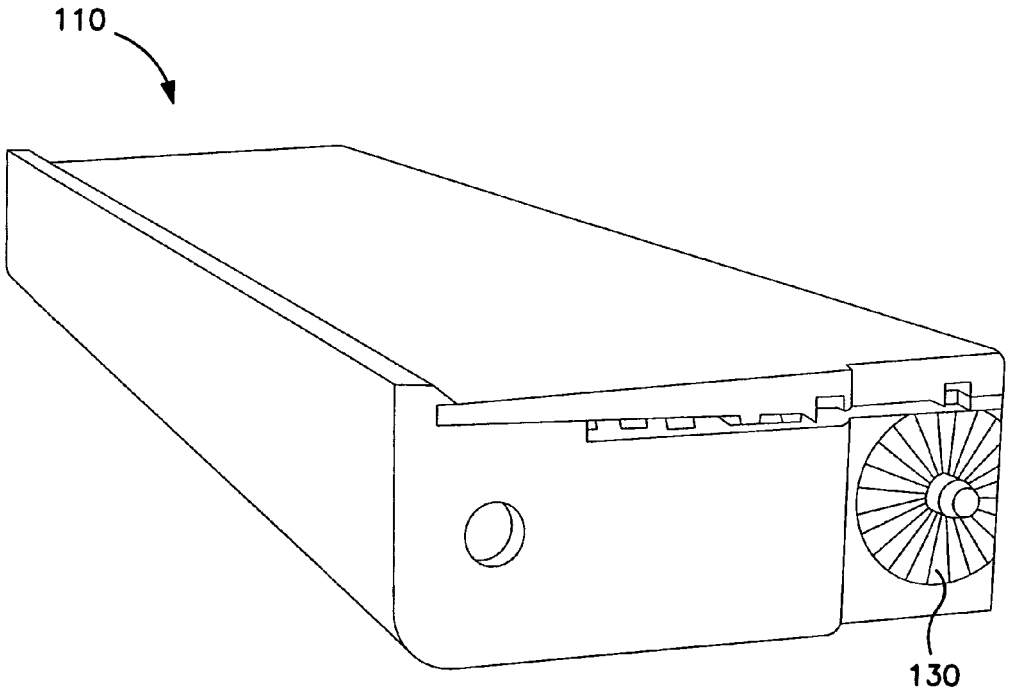
FIG. 5 is an end view of the index of FIG. 4.
Figure 6:
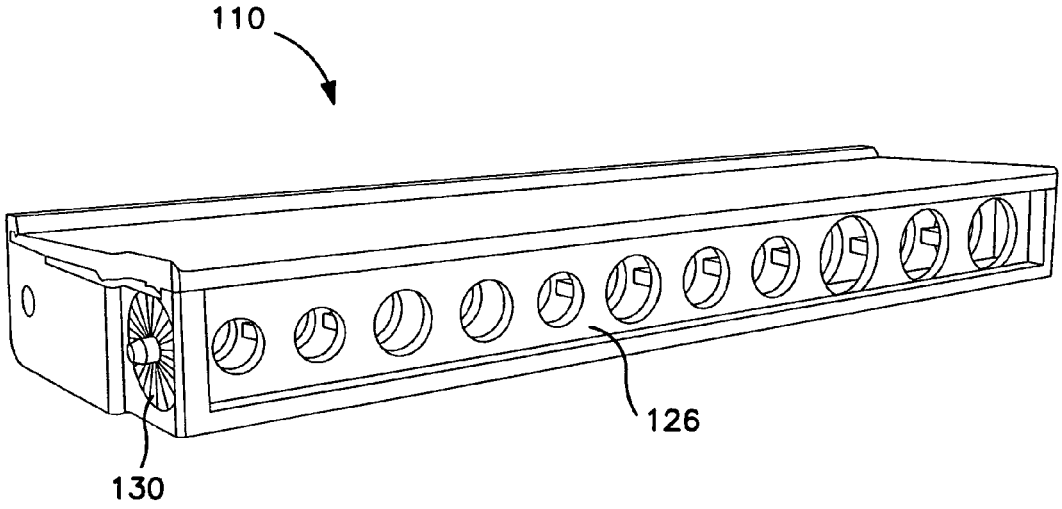
FIG. 6 is a perspective view of the index of FIG. 4.

FIG. 3 illustrates index 106 fully assembled, while FIG. 4 illustrates index 110 in the last stage of assembly. FIG. 5 is an end perspective view of index 110, showing ratchet structure 130, and FIG. 6 is a top, perspective view of index 110, showing the top portion of rack 126, and the apertures which are configured, in this embodiment, to receive the shanks of tool bits (e.g., drill bits) of progressively increasing diameter.

Figure 7:
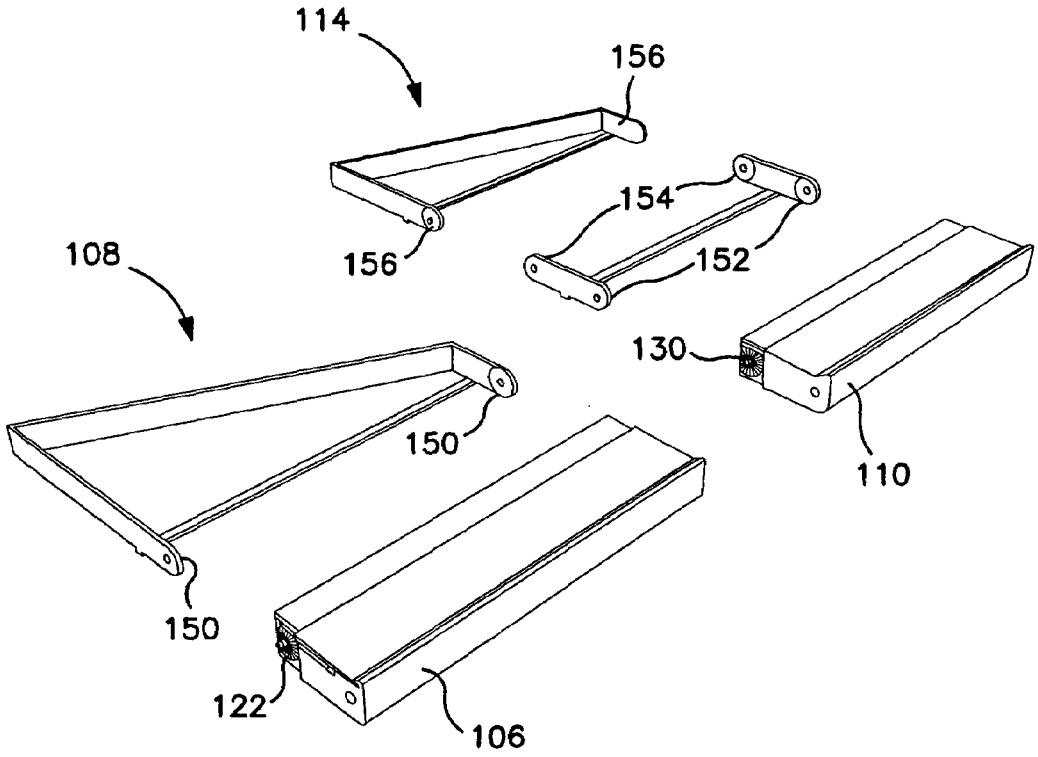
FIG. 7 is a perspective view of two assembled indexes and their movable frame parts, shown in exploded view.

FIG. 7 illustrates an exploded view of index 106 with its frame part 108, and index 110 with its frame parts 112 and 114. Frame part 108 which may be of any desired shape has formed thereon ratchet structures 150 on inwardly facing surfaces of frame part 108, each of which is configured to cooperate with a corresponding ratchet structure 122, as will be described later. Likewise, ratchet structures 152 on outwardly facing surfaces of frame part 112 will cooperate with corresponding ratchet structures 130 on index 110, and ratchet structures 154 on inwardly facing surfaces of frame part 112 will cooperate with corresponding ratchet structures 156 on outwardly facing surfaces of frame part 114. Frame part 108 is essentially a web of plastic material that forms a loop from one end to the other to define the space (when the frame part is "flat" with the index) in which the tool bits are enclosed. A bracing web, if desired, may be extended across frame part 108.

Figure 8:
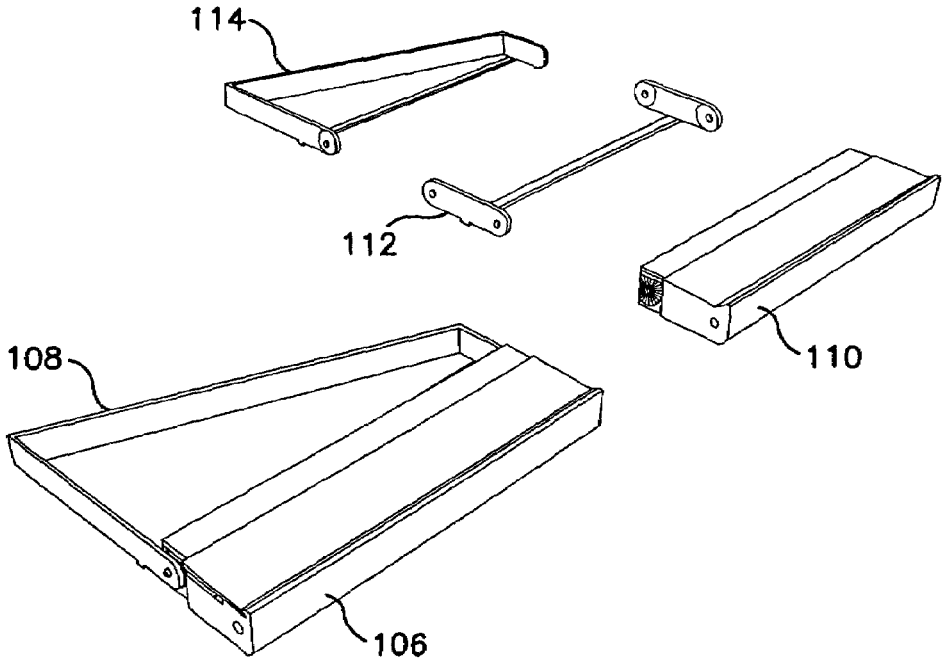
FIG. 8 is a perspective view of the components of FIG. 7, showing one of the frame parts assembled to its index.
Figure 9:
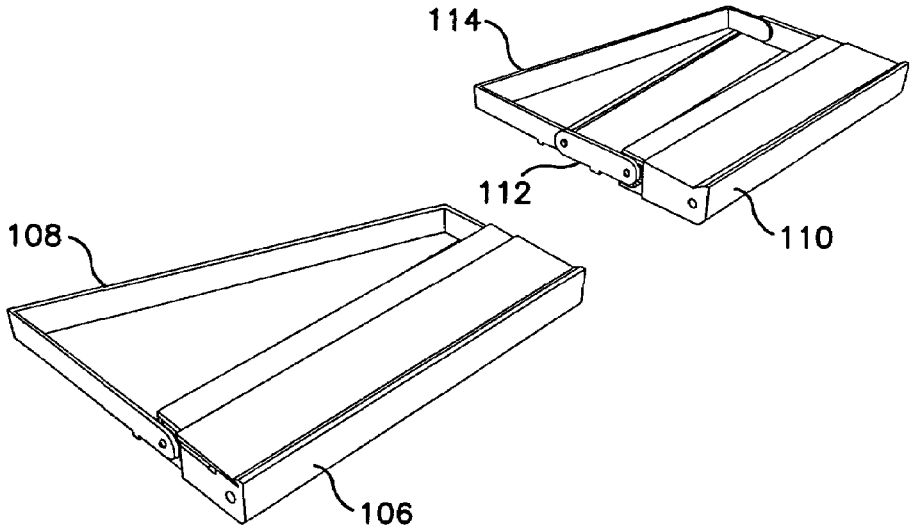
FIG. 9 is a perspective view of the components of FIG. 7, showing both frame parts assembled to their respective indexes.

FIG. 8 illustrates how frame part 108 fits onto index 106. The ends of frame part 108, being resilient, are preferably spaced apart such a distance that they need to be sprung outwardly slightly, to ride over the surfaces of ratchet structures 122, and snap into place. The cooperation of the ratchet structures on index 106 and frame part 108 will be described herein. FIG. 9 illustrates indexes 106 and 110, with frame parts 108, 112 and 114 in place.

Figure 10:
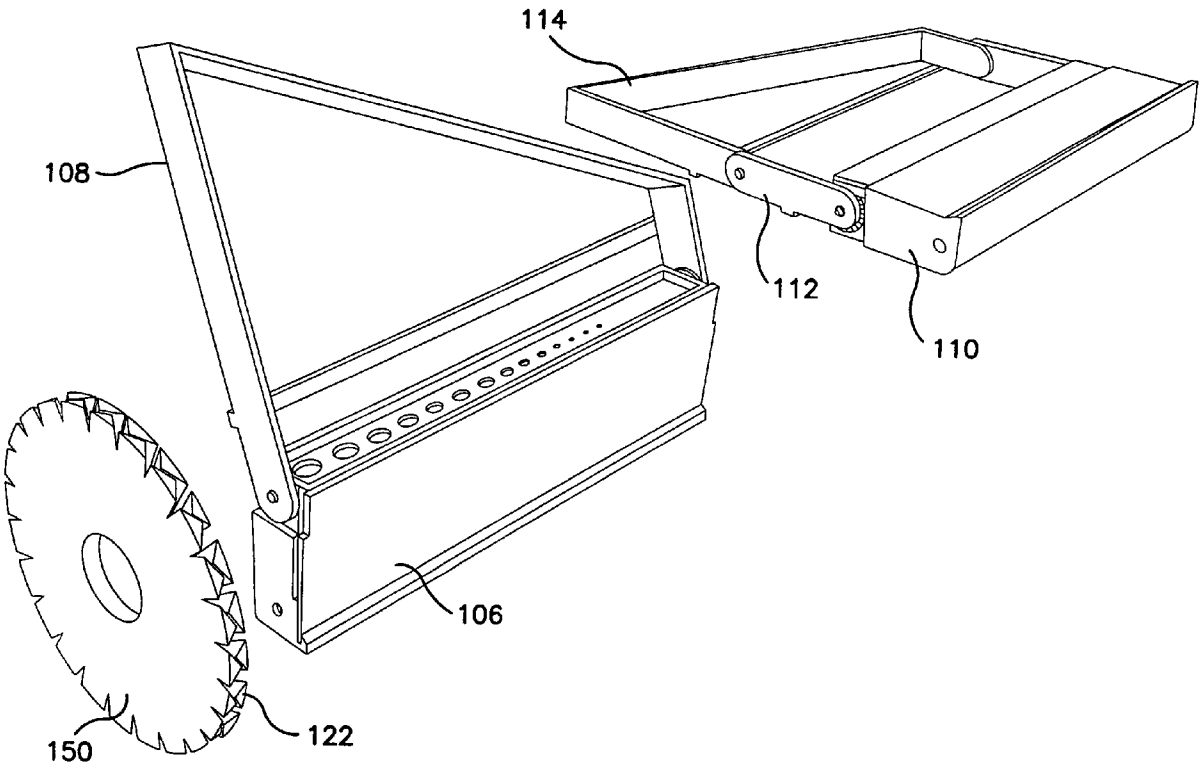
FIG. 10 is a view of the indexes of FIG. 7, with their respective frame parts, with one of the frame parts shown pivoted relative to its index.

FIG. 10 illustrates how frame part 108 can pivot relative to index 106. To the left of index 106 is a schematic illustration of how ratchet structures 122 and 150 engage. Each of ratchet structures 122 and 150 include a plurality of radially extending ridges that are triangular in cross-section. Being resiliently sprung, the ends of frame part 108 will upon application of sufficient force, move outwardly, so that the respective ridges on each of ratchet structures 122 and 150 will ride up over one another, and return into the next successive "notch" between adjacent ridges, in the known manner of ratchet-type structures.

Frame part 108 is (as is the corresponding frame structure for index 110) provided to serve several functions. It provides a structure for grasping for enabling index 106 to be pivoted out of two-piece hinged case part 102. It also provides a limit to the movement of the tools in their respective receiving bores in the index, so that during transportation or other general movement of the case, the tools are prompted to remain in the index and not become dislodged. The frame part also provides a way to shield the upper ends of the tool bits (not shown), to prevent inadvertent contact with the ends of the bits which can result in both dulling of the bits, as well as injury to persons. Also, when the frame part is pivoted back toward the interior wall of the two-piece hinged case part 102, it acts as described herein, as a stand for holding the index 106 up in a variety of possible angles relative to the horizontal (when two-piece hinged case 102 is lying open on a horizontal surface) or to the vertical, when the case is open and upright (the frame could also be pivoted outwardly and downwardly to provide support for the index from the front). Furthermore, if the index and its corresponding frame structure are removed from or otherwise used outside of a case (as discussed elsewhere herein), then the frame structure can be used to support the index at an oblique angle to a horizontal surface such as a table or bench top, or to suspend the index, such as by a pegboard or similar method. All of the foregoing functions are provided, while at the same time, not obscuring visibility of the tools, when the case is opened (or if closed, if a window is provided in the case).

Figure 11:
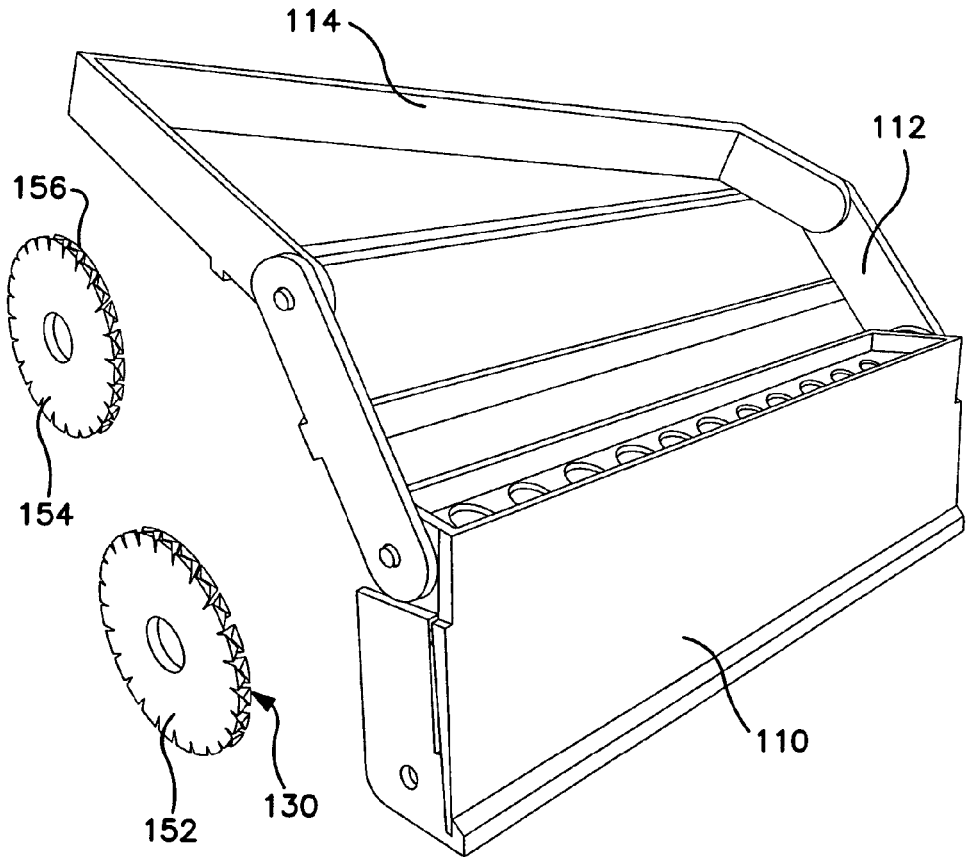
FIG. 11 is a view of an index from FIG. 7, which is provide with a two frame parts in which both components are relatively pivotable.

FIG. 11 illustrates how frame part 112 can pivot relative to index 110, and how frame part 114 can pivot relative to frame part 112. The ratchet operation, between ratchet structures 130 and 152, and between 154 and 156, illustrated schematically to the left of index 110, is the same as described with respect to the ratchet structures 122 and 150, relative to the structure of FIG. 10. The "lower" ends of frame part 112 will be sprung outwardly and snapped over the ratchet structures of index 110, while the ends of frame part 114 will be sprung inwardly to fit between the "upper" ends of frame part 112.

Figure 12:
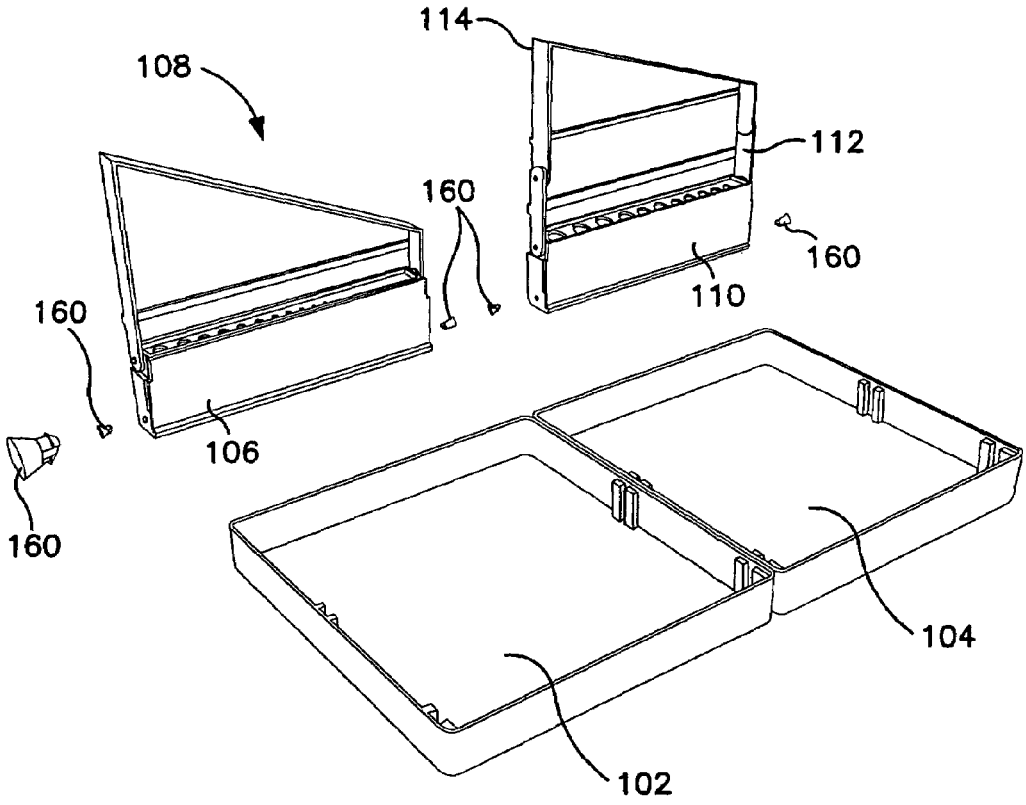
FIG. 12 is a perspective view of a two-piece hinged case, with two indexes and their respective frame parts, prior to placement of the indexes in the two-piece hinged case parts.
Figure 13:
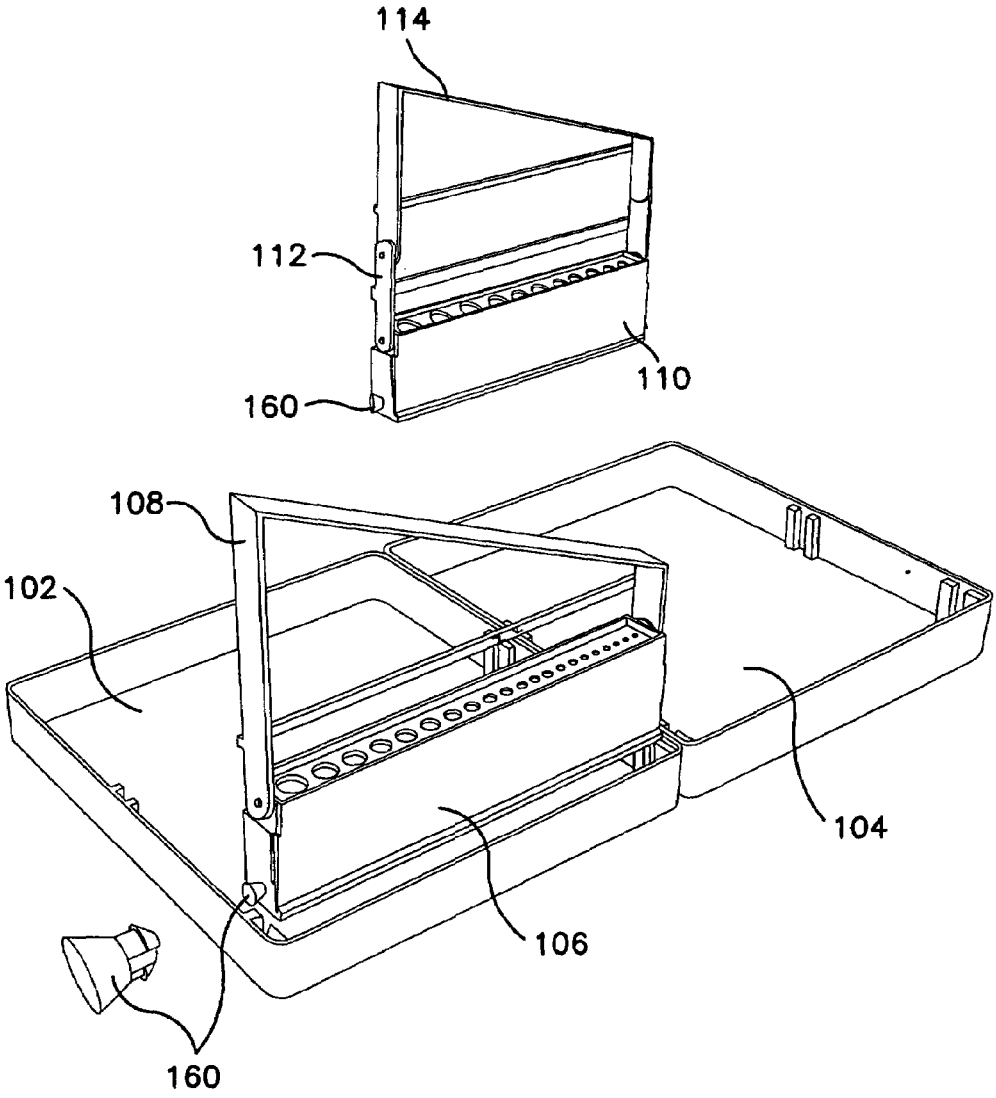
FIG. 13 is a perspective view of the case of FIG. 12, with one of the indexes about to be positioned in a two-piece hinged case part.

Once the indexes and frame parts have been assembled, then the index/frame part assemblies are placed into and attached to their respective two-piece hinged case parts 102, 104. Pivot pins 160 (one is shown enlarged to the left of FIG. 12) are inserted into apertures 121, 138 of indexes 106, 110. Each pivot pin 160 includes resilient barbs at one end and a conical outer end. These conical outer ends are configured to be slidingly received in trapezoidal slots 160 (see FIG. 36) that are formed by pairs of ridges extending inwardly from the inside surfaces of the two-piece hinged case parts. The fit should be tight enough to provide for sufficient friction to prevent indexes 106, 110 from falling out, upon opening of the case, and may be sufficiently tight to provide enough force to keep an index at an elevated pivoted position out of case parts 102, 104, but not so tight as to make pivoting of indexes 106, 110 relative to the two-piece hinged case parts difficult.

Although not shown, it is to be understood that if desired, ratchet structures as described herein could be provided in the interfacing surfaces between the index and the case surfaces, to provide additional rotational positioning control, to enable the index to be placed in any of a plurality of temporary positions and held there, during use.

Figure 14:
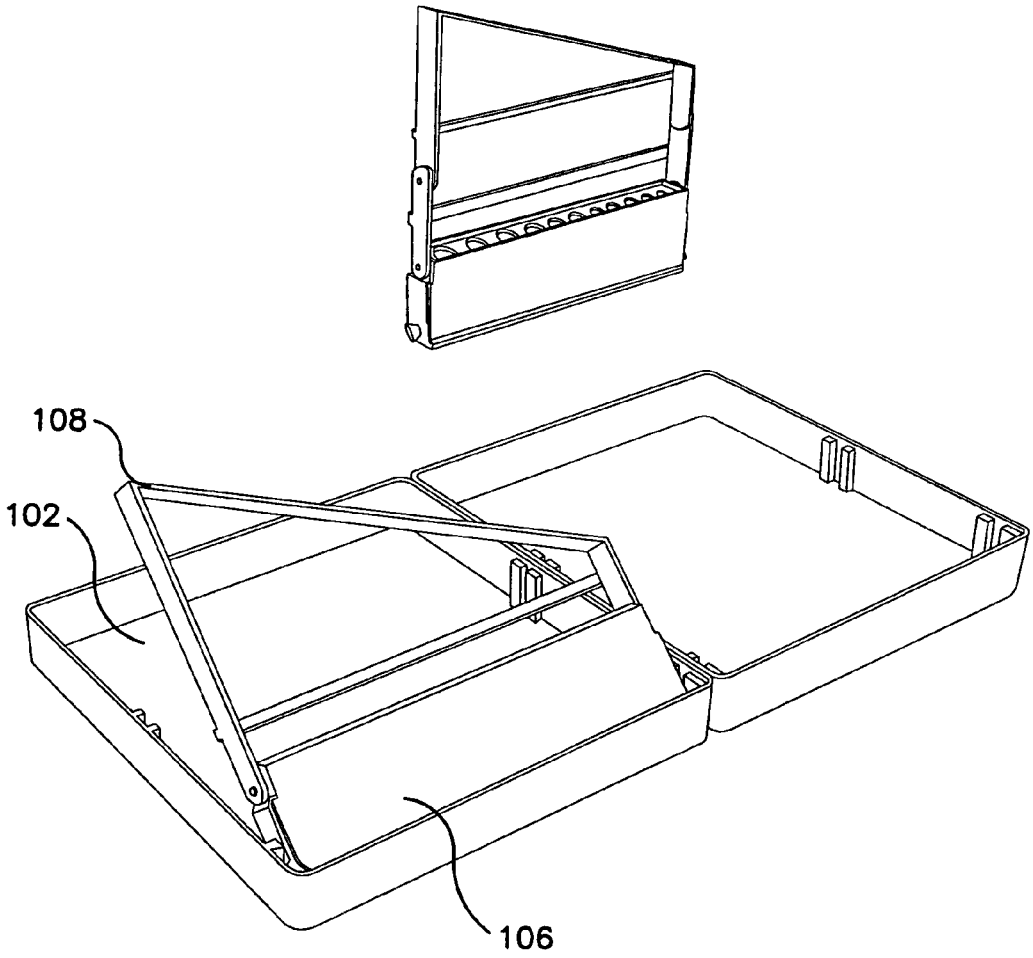
FIG. 14 is a perspective view illustrating the pivoting movement of an index and frame part relative to a two-piece hinged case part, in a case according to FIG. 12.
Figure 15:
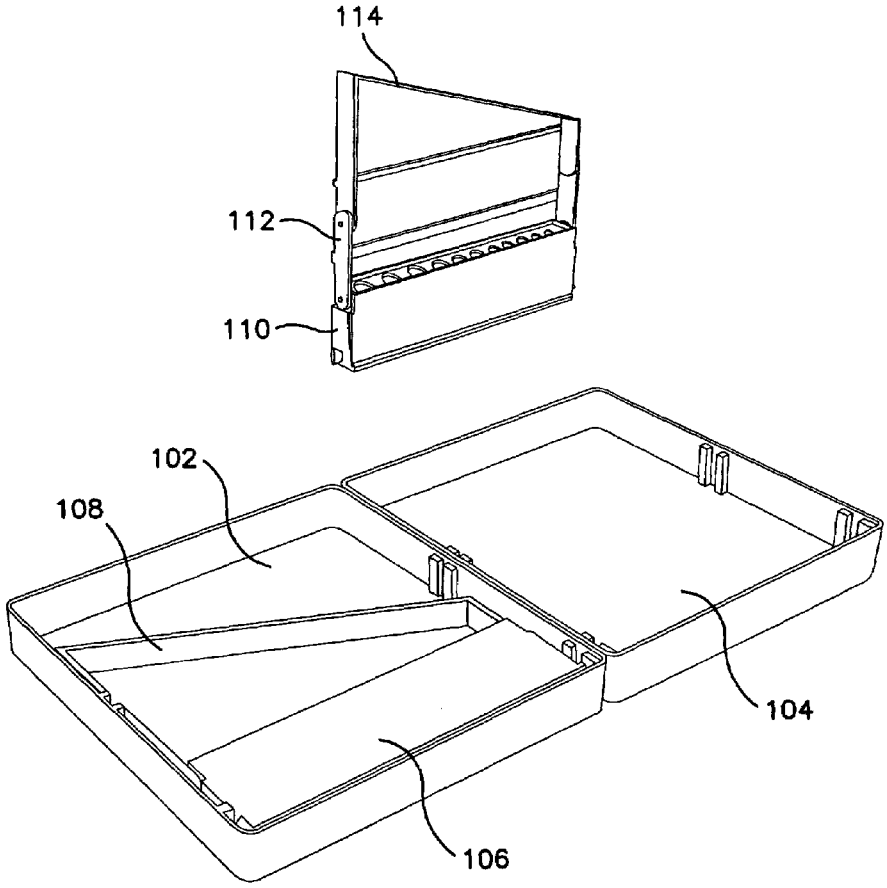
FIG. 15 is a perspective view of the case of FIG. 12, showing how an index and frame part can pivot into a recessed or stowed position within a two-piece hinged case part.
Figure 16:
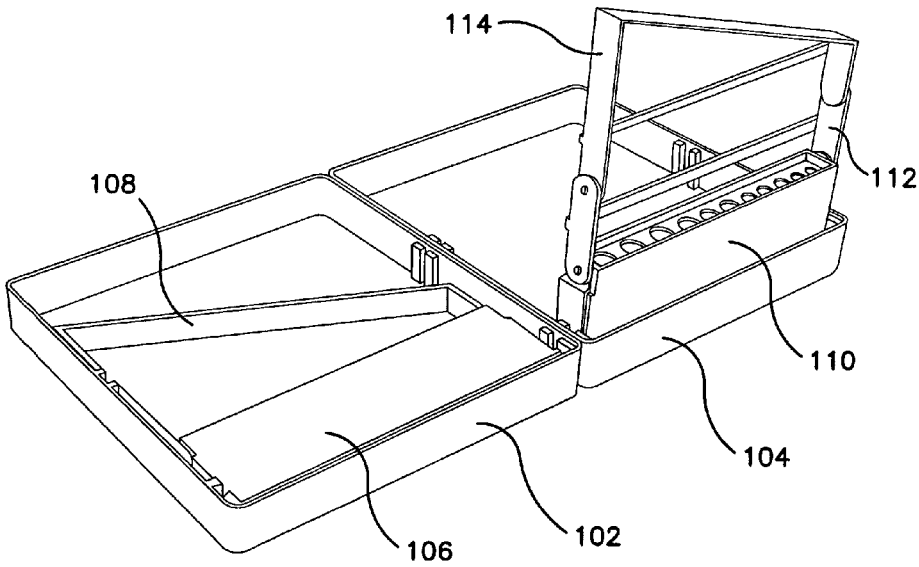
FIG. 16 is a perspective view of the case of FIG. 12, with both indexes inserted into their respective two-piece hinged case parts, with one in a raised or deployed position.
Figure 17:
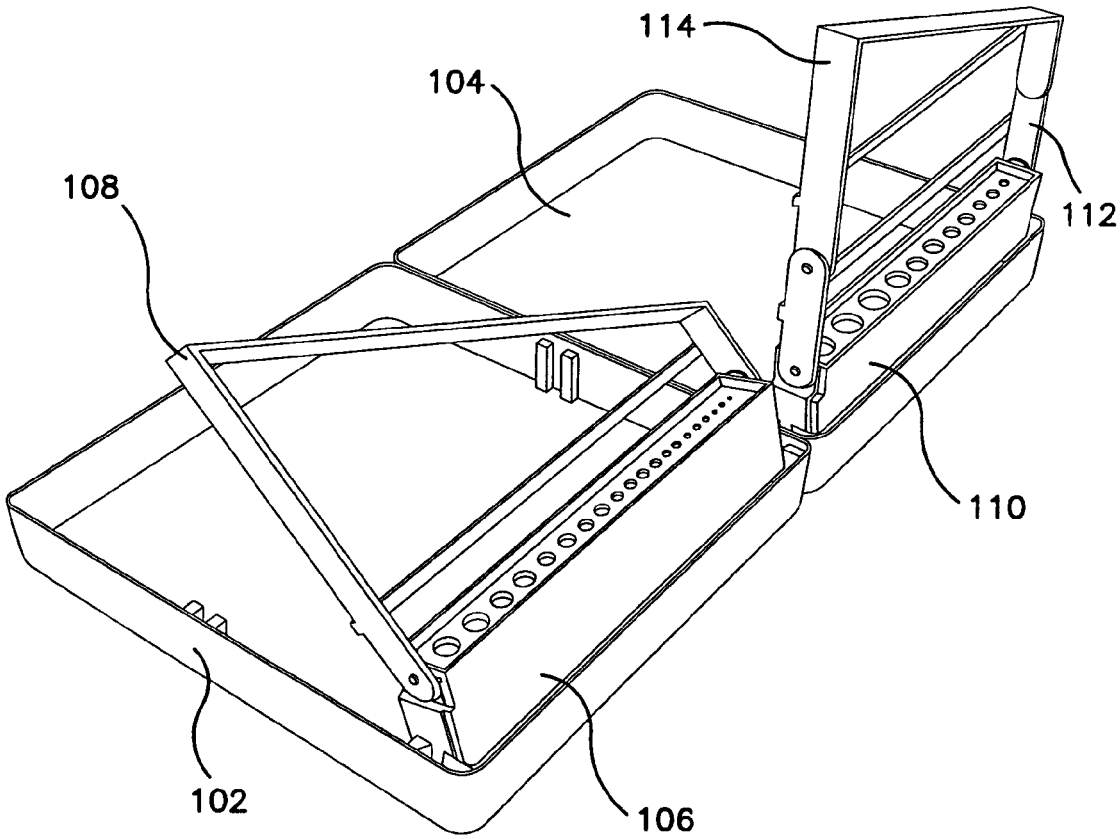
FIG. 17 is a perspective view of the case of FIG. 12, with one frame part pivoted relative to its respective index.
Figure 18:
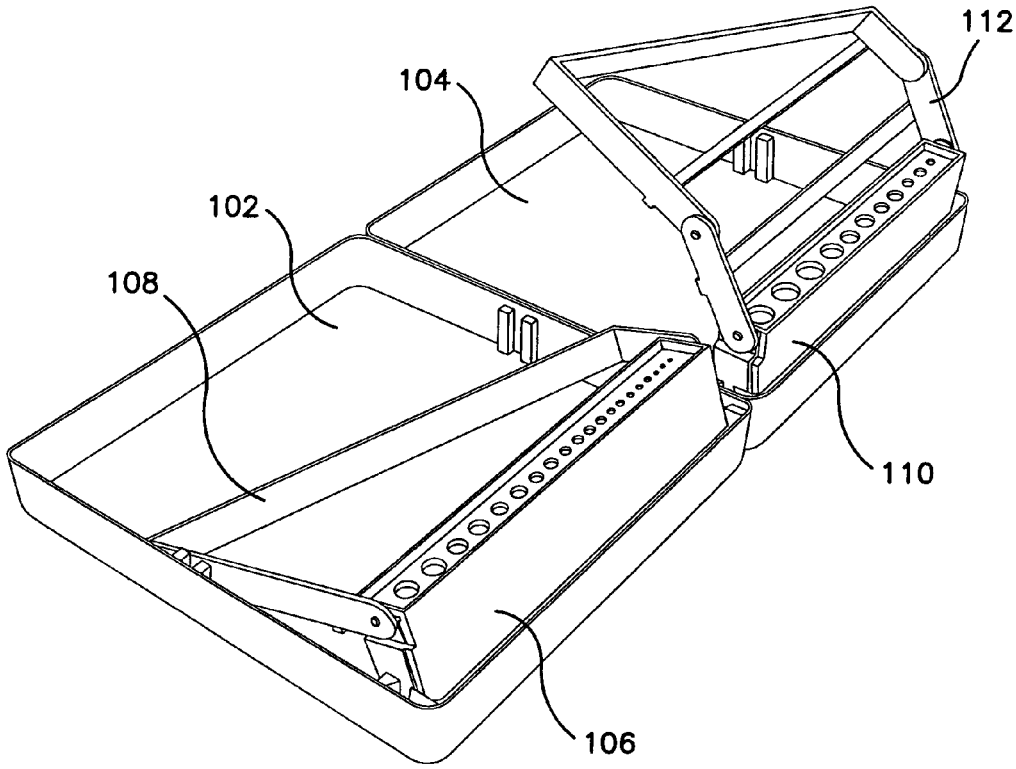
FIG. 18 is a perspective view of the case of FIG. 12, with both frame parts pivoted relative to their respective indexes.

FIG. 14 shows how index 106 is capable of pivoting relative to two-piece hinged case part 102. FIG. 15 shows how the index 106 and frame part 108 can be made to lie flat in two-piece hinged case part 102. FIG. 16 shows index 106 and frame part 108 lying flat, while index 110 and frame parts 112, 114 are standing upright in two-piece hinged case part 104. Pivoting of frame part 108 relative to index 106 is shown in FIG. 17, while in FIG. 18, it is shown how by appropriate positioning of frame part 108 relative to index 106, index 106 can be supported at an oblique angle relative to the back wall of two-piece hinged case part 102. FIG. 18 also shows the pivoting of frame part 112 relative to index 110, and of frame part 114 relative to frame part 112.

Figure 19:
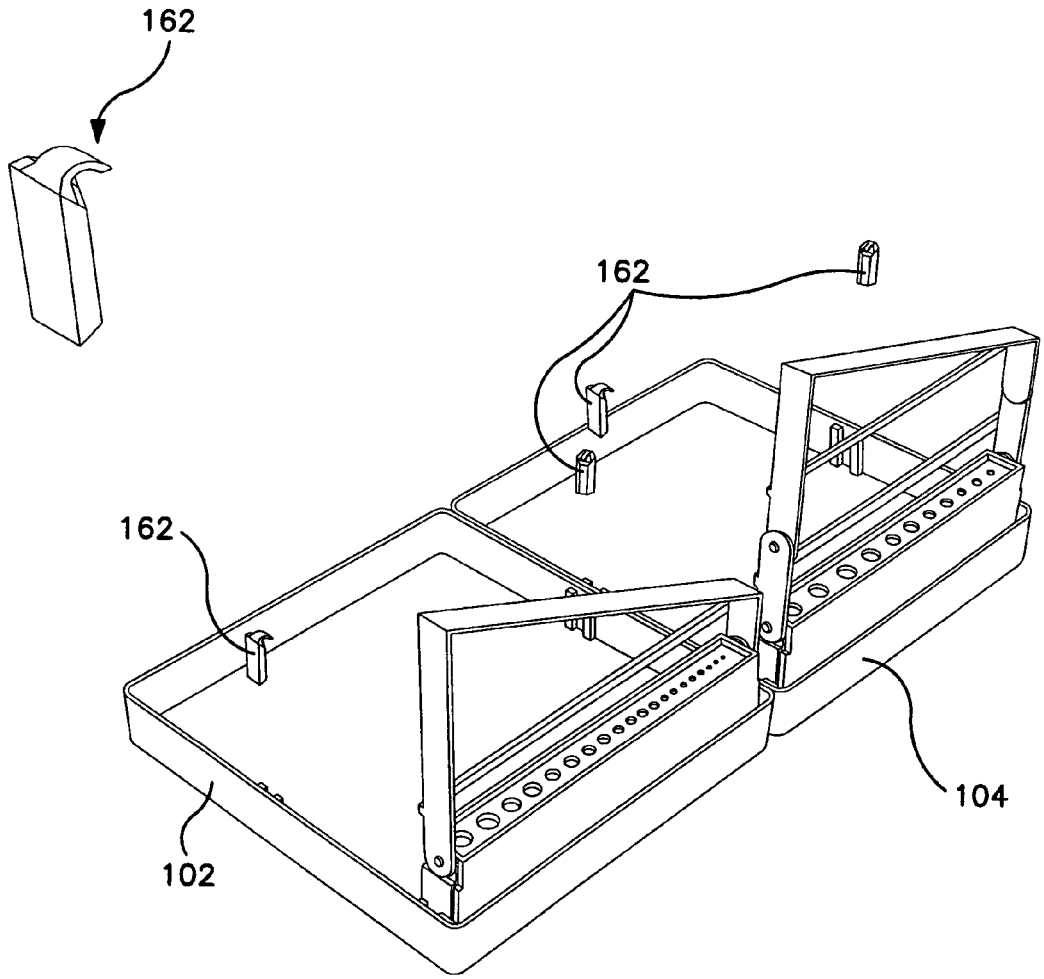
FIG. 19 is a perspective view of the case of FIG. 12 with both indexes deployed.

When the indexes 106, 110 have been mounted into two-piece hinged case parts 102, 104, retaining pins 162 (see FIGS. 38-41) may be inserted if desired (FIG. 19), into trapezoidal slots 164 (see also FIG. 36-37) in two-piece hinged case parts 102, 104. Each retaining pin 162 has one or more side surfaces that are roughened, for example by small barbed projections 163, as shown in schematic form in FIG. 39, in which the sloping portions of the projections 163 are directed to the "in" direction, and the perpendicular portions of projections 163 are directed to the "out" direction, so that when each pin 162 is pushed in, there is relatively low resistance, but when a pulling force is exerted on a pin 162, there is substantially increased resistance.

Each retaining pin 162 has a hook 166 that is resilient, and configured to engage adjacent portions of any frame part that passes it, to help hold the indexes and their respective frame parts in place, until affirmatively pulled up and out into their deployed positions. For example, when an index is being pushed down into its case part 102, 104, as the frame part 165 pushes down on hook 166, hook 166 is pushed downward and inwardly, as shown by the arrow in FIG. 40. Once the frame part (shown in broken lines as 165) passes the position of pushed in hook 166, hook 166 is free to resiliently return to its unbent position, preventing frame part 165 from passing hook 166. Preferably, there is sufficient vertical and lateral spacing between a frame part 165 and hook 166, so that when it is desired to flip up the index associated with frame part 165, hook 166 is simply pushed down and held in place, while frame part 165 is lifted up, causing its associated index to be likewise pivoted up.

Figure 20:
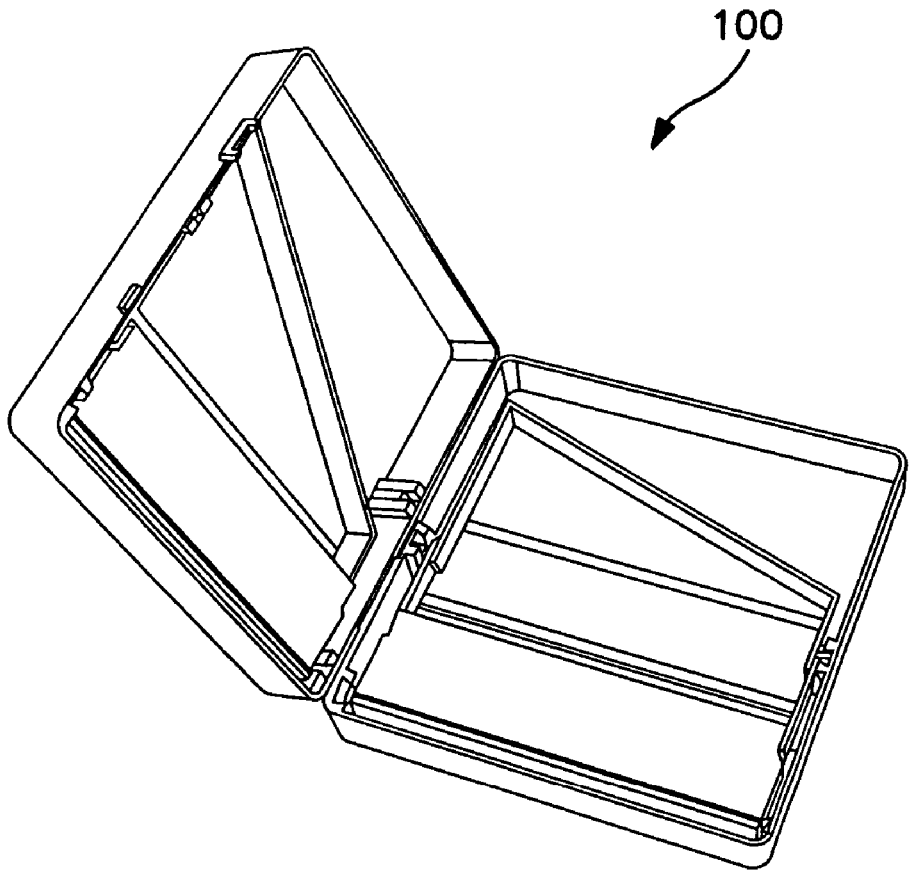
FIG. 20 is a perspective view of the case of FIG. 12 with both indexes stowed and the case partially closed.
Figure 24:
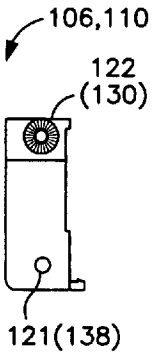
FIG. 24 is an end view of the index cover part of FIG. 21.

While the retaining pins 162 are shown as being inserted into case parts 102, 104, it is to be understood that retaining pins 162 could also be integrally formed into case parts 102, 104, either as separate pieces that are later affixed in place, or as projections monolithically formed on case parts 102, 104. In addition, while pins 162 are shown as engaging only frame parts, it is to be understood that pins could also be positioned to releasably engage indexes 106, 110 directly. FIG. 20 shows case 100 partially closed.

Figure 25:
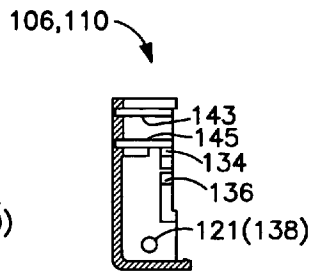
FIG. 25 is a sectional end view of the index cover part of FIG. 21.
Figure 21:
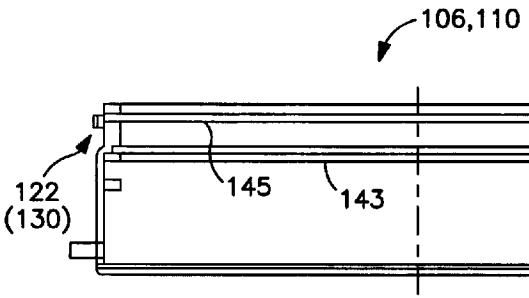
FIG. 21 is an inside elevation of one part of an index case according to the present invention.
Figure 22:
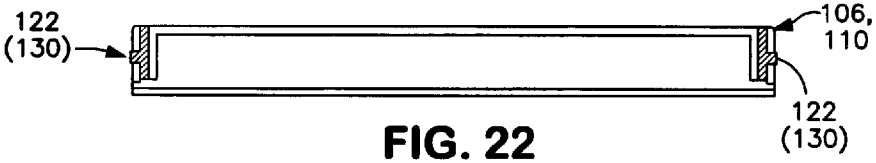
FIG. 22 is a top view of the index cover part of FIG. 21.
Figure 23:
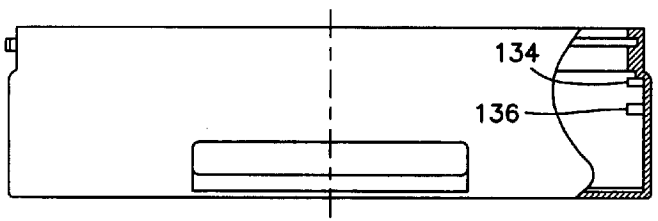
FIG. 23 is a rear view, partially in section, of the index cover part of FIG. 21.
Figure 29:
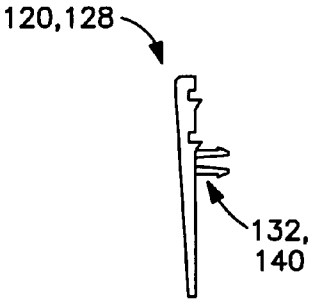
FIG. 29 is a side elevation of the index cover part of FIG. 26.
Figure 26:
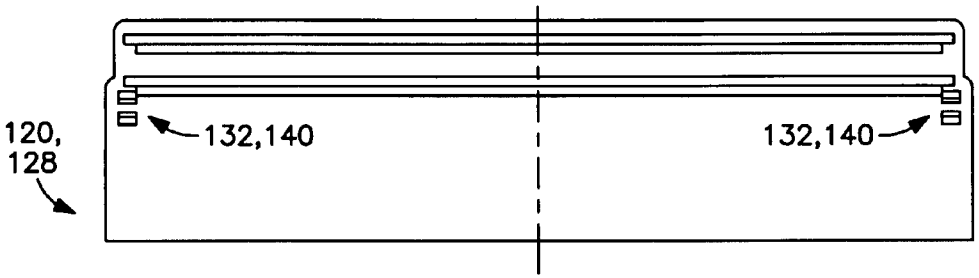
FIG. 26 is an inside elevation of the other part of an index case according to the present invention.
Figure 27:
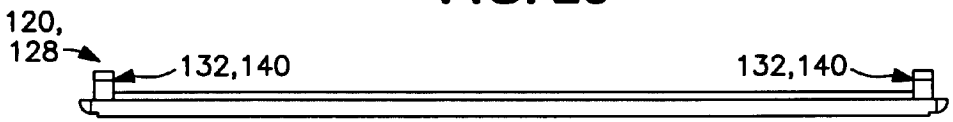
FIG. 27 is a top view of the index cover part of FIG. 26.
Figure 28:
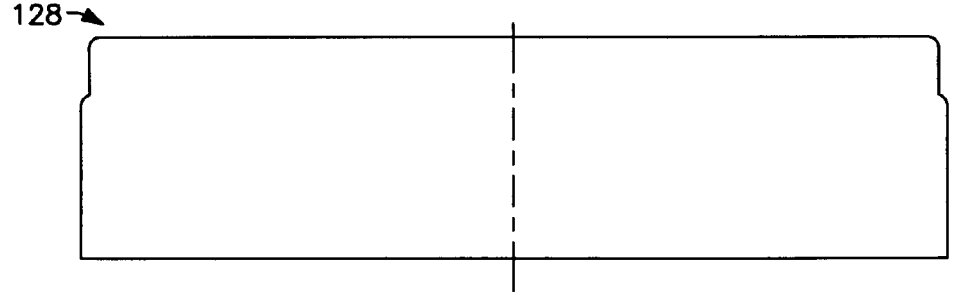
FIG. 28 is a rear view of the index cover part of FIG. 26.

FIGS. 21-25 illustrate index cover part 116 (124) which may be identical as illustrated or which may have structural differences not directed to the principles of the invention, which has formed thereon ratchet structures 122 (130) (shown somewhat schematically in FIG. 24), and apertures 121 (138). In addition, FIGS. 21 and 25 particularly illustrate slots 143, 145 located on the inside surface of index cover part 106 (110) that are to receive the side edges of racks 118, 126. FIGS. 23 and 25 particularly illustrate pegs 134, 136 that are engaged by barbs 132 (140) (which, as illustrated may be identical, or which may have other configurations as desired).

Figure 30:
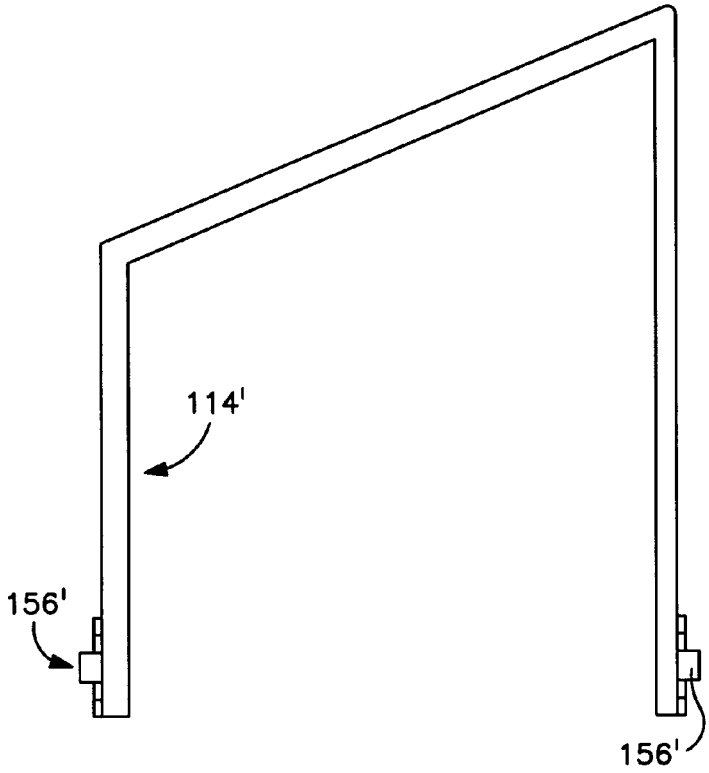
FIG. 30 is a side elevation of a frame part which may be used with an index of the present invention.
Figure 32:
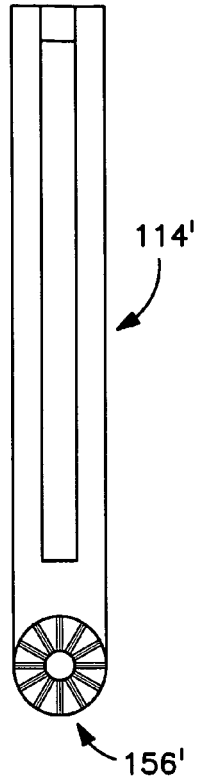
FIG. 32 is a end view of the frame part of FIG. 30.
Figure 31:
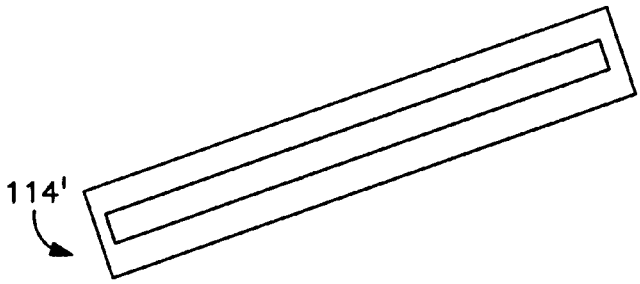
FIG. 31 is an top view of the frame part of FIG. 30.
Figure 34:
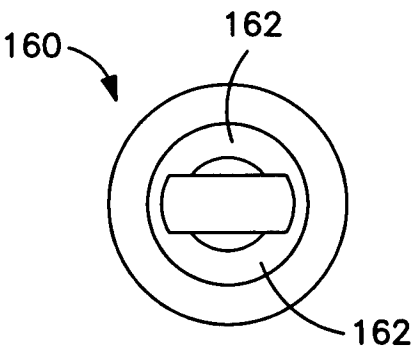
FIG. 34 is an end view of the pivot pin of FIG. 33.
Figure 33:
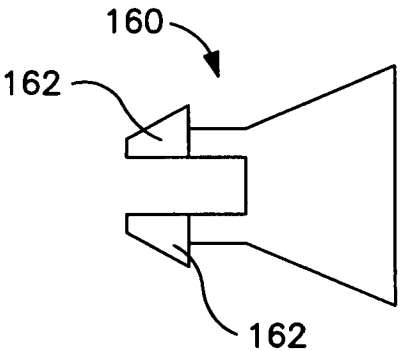
FIG. 33 is a side elevation of a pivot pin for use with an index of the present invention.
Figure 35:
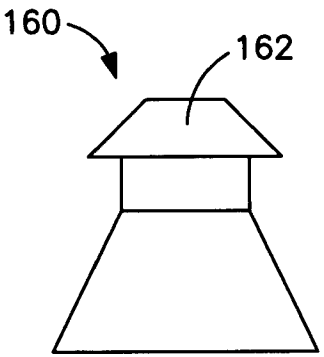
FIG. 35 is a front view of the pivot pin of FIG. 33, rotated 90° from the view of FIG. 33.

FIGS. 26-29 illustrate index cover part 120 (128) which may be identical as illustrated or which may have structural differences not directed to the principles of the invention, which includes barbs 132 (140) (which, as illustrated may be identical, or which may have other configurations as desired) which are configured to engage pegs 134, 136 of index cover part 116 (124). FIGS. 30-32 illustrate a frame part 114' that is analogous to frame parts 108 and 114 of FIGS. 1-21, having ratchet structures 156'. FIGS. 33-35 illustrate pivot pin 160, incorporating resilient barbs 162, which deflect when the conical end of a pivot pin 160 is pushed into an aperture 121 (138), and snap back once the barbs have been pushed into the interior region of each index cover part 116 (124).

Figure 35B:
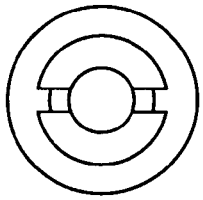
FIGS. 35A-35C illustrate a pivot pin construction.
Figure 35A:
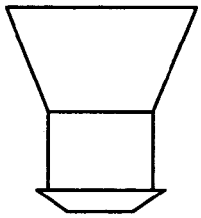
Figure 35C:
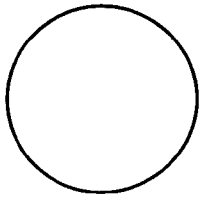
Figure 35E:
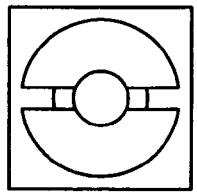
FIGS. 35D-35F illustrate another pivot pin construction.
Figure 35D:
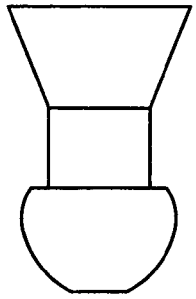
Figure 35F:
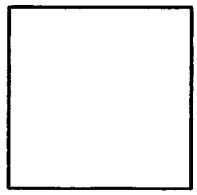
Figure 35H:
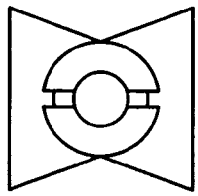
FIGS. 35G-35I illustrate another pivot pin construction.
Figure 35G:
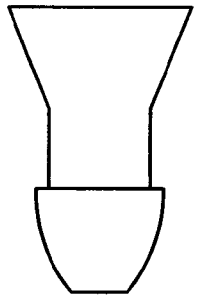
Figure 35I:
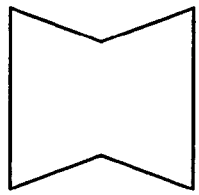

FIGS. 35A-35C illustrate another pivot pin, having a split front end, and a conical base or foot. FIGS. 35D-35F illustrate a pivot pin, having a domed split front end, and a pyramidal base or foot (which can lock into the trapezoidal slot) so that rotation of an index occurs between the contact surface between the index and the pin, and not between the pin and the slot surfaces). FIGS. 35G-35I illustrate a pin having a pyramidal basic that is bowtie-shaped in plan. In each pin construction the shaft and front end of the pins are bodies of revolution preferably having circular (although other cross-sections are contemplated) cross-sections that are split, to permit snap-fit insertion into the apertures in the ends of the indexes.

Figure 37:
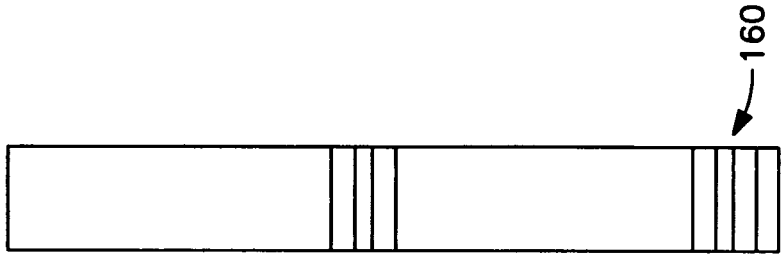
FIG. 37 is a side sectional view of the two-piece hinged case part of FIG. 36, taken along line A-A of FIG. 36.
Figure 36:
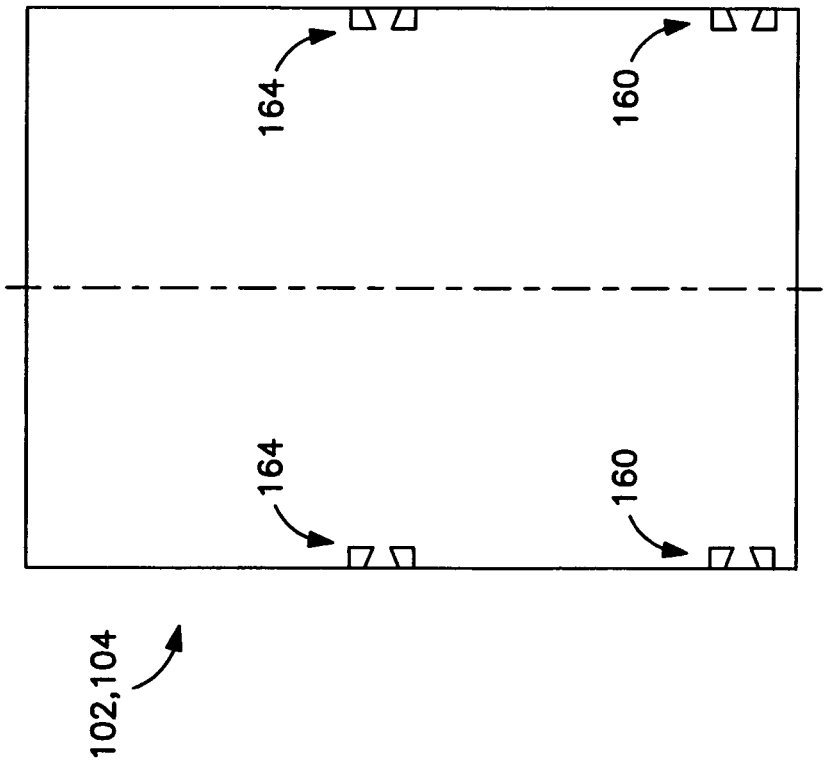
FIG. 36 is a top plan view of a two-piece hinged case part according to the present invention.
Figure 40:
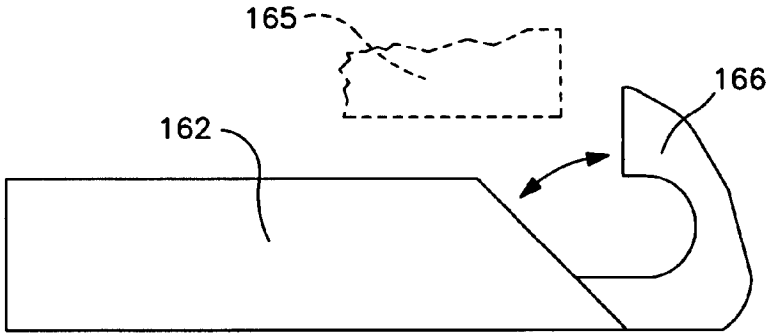
FIG. 40 is a side view of the retaining pin of FIG. 38.
Figure 38:
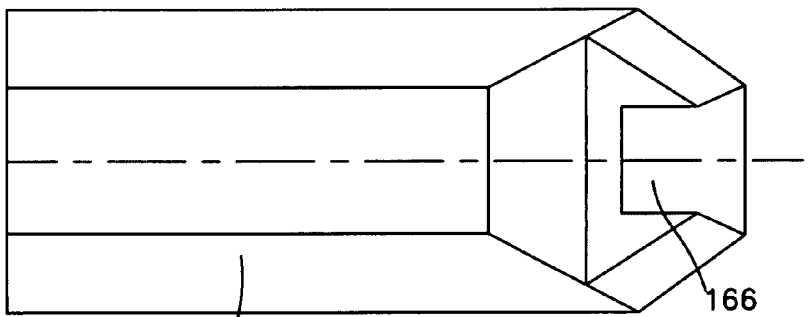
FIG. 38 is a front view of a retaining pin for use in a two-piece hinged case of the present invention.
Figure 41:
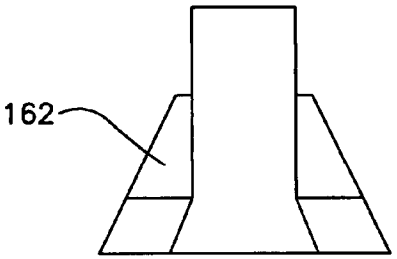
FIG. 41 is an end view of the retaining pin of FIG. 38.
Figure 39:
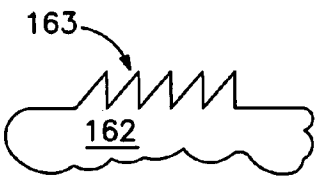
FIG. 39 is an enlarged detail of a surface contour of the retaining pin, according to one embodiment of the invention.

FIGS. 36, 37 illustrate an alternative configuration of an interior for a two-piece hinged case part, which is provided with more slots for receiving the end of pivot pins and/or other insertable components, such as retaining pins. FIGS. 36, 37 illustrate in further detail the configuration of the interior for two-piece hinged case parts 102, 104, showing slots 160 for receiving the pivot pins for the indexes, and slots 164 for receiving the retaining pins of FIGS. 38-41.

FIGS. 42-44, 45-47, 48-50, and 51-53 illustrate pairs of mating ratchet structures which could be used for any of the pairs of ratchet structures (122, 150; 130, 152; 154, 156) that have been identified herein. The ratchet structures are complementary, and the respective structures can be mounted on or formed in either of the respective facing surfaces, in the index cover parts and frame parts.

Figure 43:
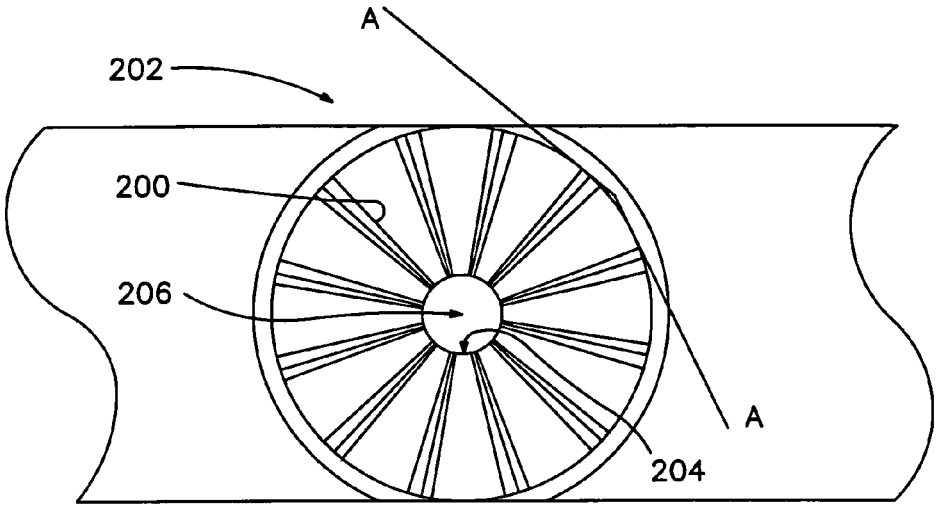
FIG. 43 is an elevation of one component of the ratcheting mechanism of FIG. 42.
Figure 42:
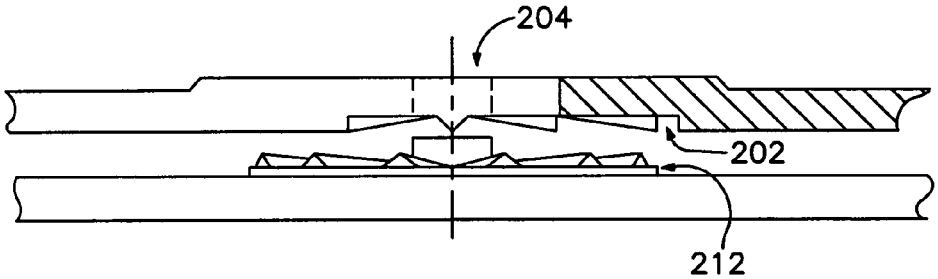
FIG. 42 is a side elevation in section of the ratcheting mechanism in the interface between the frame parts and the indexes, according to one embodiment of the present invention.
Figure 44:
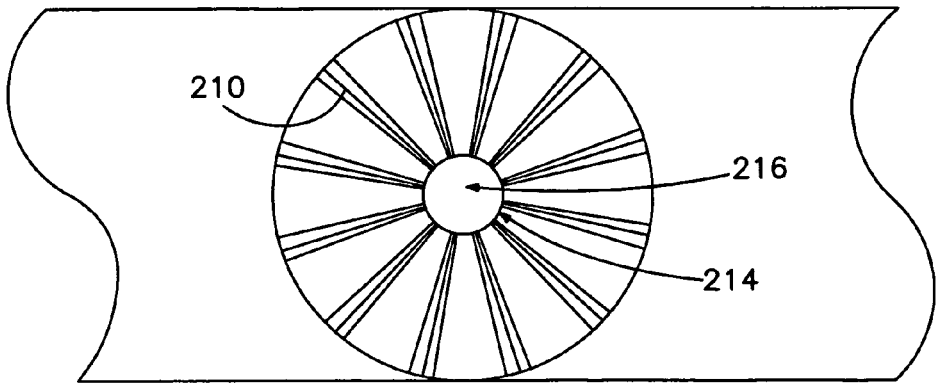
FIG. 44 is an elevation of the other component of the ratcheting mechanism of FIG. 42.

In FIGS. 42-44, the matching pair of ratchet structures includes, on one of the mating surfaces, a "female" structure of twelve (although a higher or lower number could be used) radiating ribs 200, that are set in a recess 202, concentrically surrounding a bore or aperture 204. Each of ribs 200 preferably has a triangular cross-section that preferably increases in height and width, with distance from the center 206. On the other mating surface, a "male" structure of twelve (although a like higher or lower number could be used) radiating ribs 210, that are set on a raised circular pedestal 212, concentrically surrounding a cylindrical post 214. Each of ribs 210 likewise preferably has a triangular cross-section that is the same as that of corresponding ribs 200, which preferably increases in height and width, with distance from center 216. Ribs 200 and 210 will be preferably uniformly circumferentially spaced around their respective centers 206, 216, with ribs 210 being offset by, e.g., 15°. When the surfaces are mated, post 214 will be insertingly received in bore or aperture 204, to help keep the surfaces aligned. When a torsional force is exerted, at a certain point the force will exceed the resistance and bending strength of the leg of the frame part upon which one or the other of the ratchet structures is positioned, and the leg will bend sufficient to permit the ribs on that leg to "ride up" and over the ribs of the other corresponding ratchet structure, in the usual manner of such structures. As soon as the torsional force is reduced or removed, the structures will remain in their new positions until acted upon again by a sufficiently strong torsional force.

Figure 46:
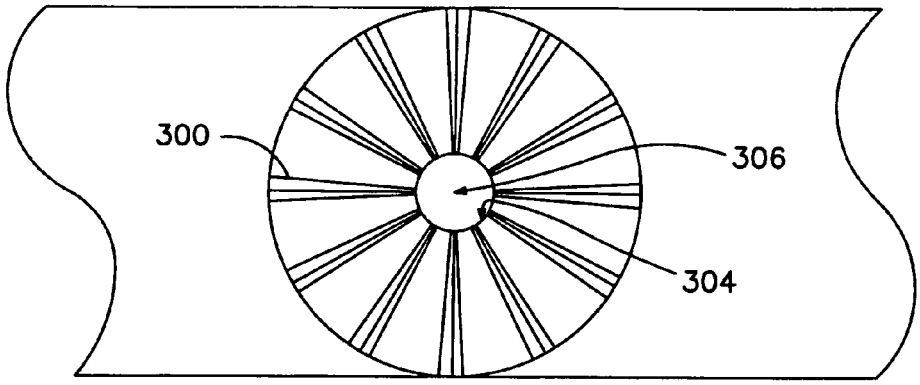
FIG. 46 is an elevation of one component of the ratcheting mechanism of FIG. 45.
Figure 45:
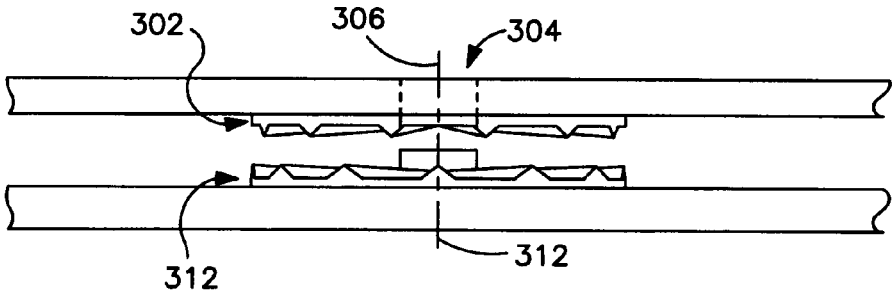
FIG. 45 is a side elevation in section of the ratcheting mechanism in the interface between the frame parts and the indexes, according to another embodiment of the present invention.
Figure 47:
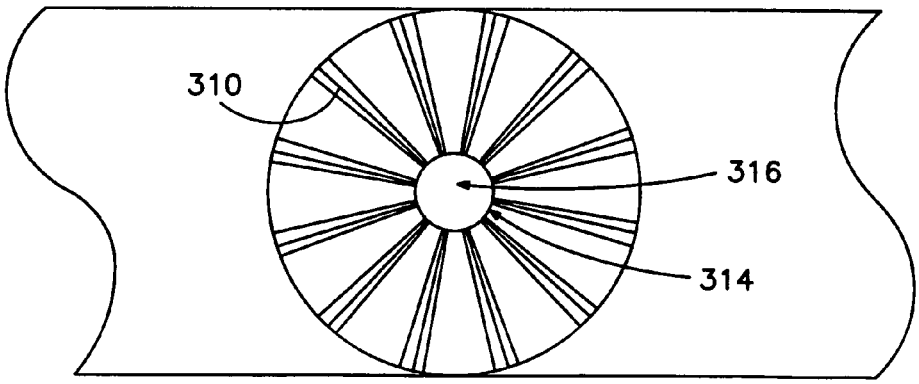
FIG. 47 is an elevation of the other component of the ratcheting mechanism of FIG. 45.

In FIGS. 45-47, the matching pair of ratchet structures includes, on one of the mating surfaces, a "male" structure of twelve (although a higher or lower number could be used) radiating ribs 300, that are set on a raised circular pedestal 302, concentrically surrounding a bore or aperture 304. Each of ribs 300 preferably has a triangular cross-section that preferably increases in height and width, with distance from the center 306. On the other mating surface, a "male" structure of twelve (although a like higher or lower number could be used) radiating ribs 310, that are set on a raised circular pedestal 312, concentrically surrounding a cylindrical post 314. Each of ribs 310 likewise preferably has a triangular cross-section that is the same as that of corresponding ribs 300, which preferably increases in height and width, with distance from center 316. Ribs 300 and 310 will be preferably uniformly circumferentially spaced around their respective centers 306, 316, with ribs 310 being offset by, e.g., 15°. In operation, when the surfaces are mated, post 314 will be insertingly received in bore or aperture 304, to help keep the mating surfaces aligned. The ratcheting action is as described with respect to FIGS. 42-44.

Figure 49:
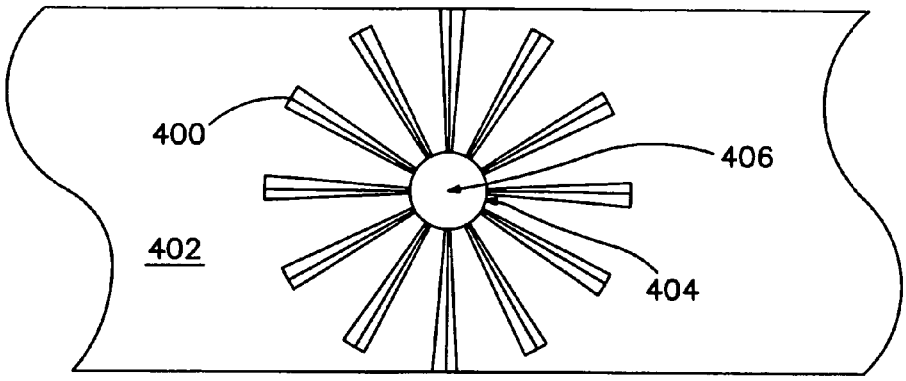
FIG. 49 is an elevation of one component of the ratcheting mechanism of FIG. 48.
Figure 48:
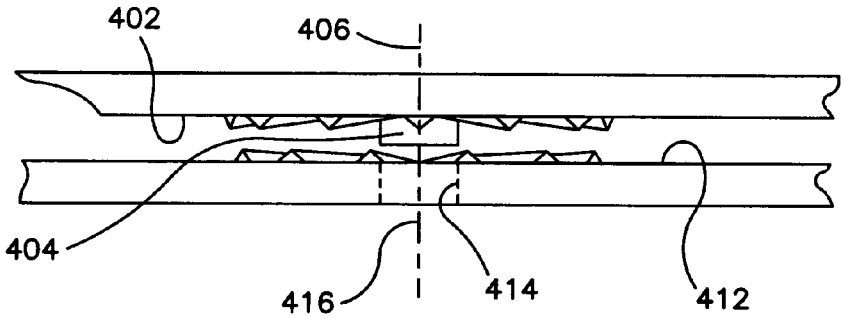
FIG. 48 is a side elevation in section of the ratcheting mechanism in the interface between the frame parts and the indexes, according to another embodiment of the present invention.
Figure 50:
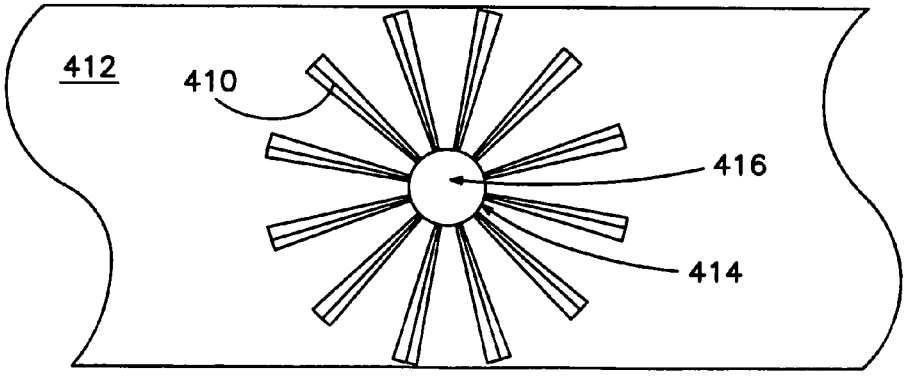
FIG. 50 is an elevation of the other component of the ratcheting mechanism of FIG. 48.

In FIGS. 48-50, the matching pair of ratchet structures includes, on one of the mating surfaces, a "male" structure of twelve (although a higher or lower number could be used) radiating ribs 400, that are set flat on the mating surface 402, concentrically surrounding a cylindrical post 404. Each of ribs 400 preferably has a triangular cross-section that preferably increases in height and width, with distance from the center 406. On the other mating surface, a "male" structure of twelve (although a like higher or lower number could be used) radiating ribs 410, that are set flat on the mating surface 412, concentrically surrounding a cylindrical bore or aperture 414. Each of ribs 410 likewise preferably has a triangular cross-section that is the same as that of corresponding ribs 400, which preferably increases in height and width, with distance from center 416. Ribs 400 and 410 will be preferably uniformly circumferentially spaced around their respective centers 406, 416, with ribs 410 being offset by, e.g., 15°. In operation, when the surfaces are mated, post 404 will be insertingly received in bore or aperture 414, to help keep the mating surfaces aligned. The ratcheting action is as described with respect to FIGS. 42-44.

Figure 52:
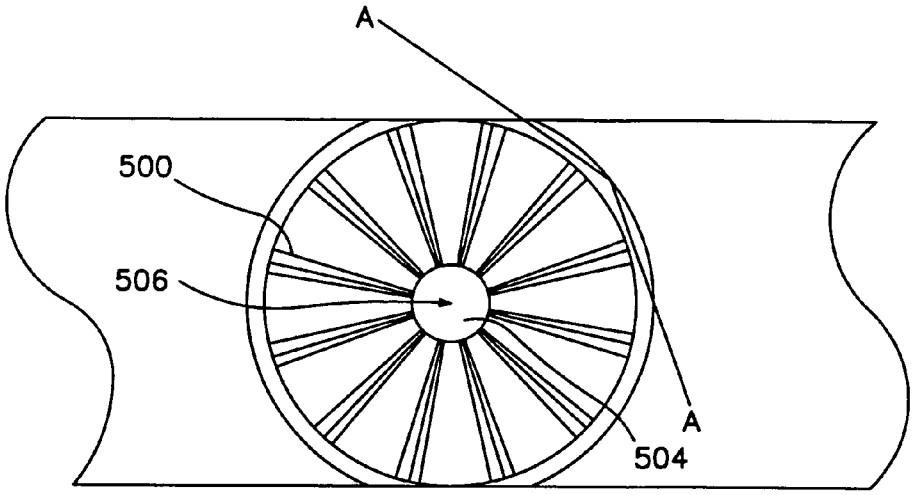
FIG. 52 is an elevation of one component of the ratcheting mechanism of FIG. 51.
Figure 51:
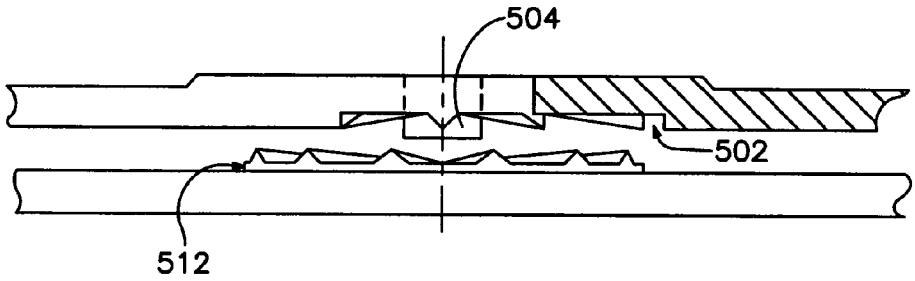
FIG. 51 is a side elevation in section of the ratcheting mechanism in the interface between the frame parts and the indexes, according to another embodiment of the present invention.
Figure 53:
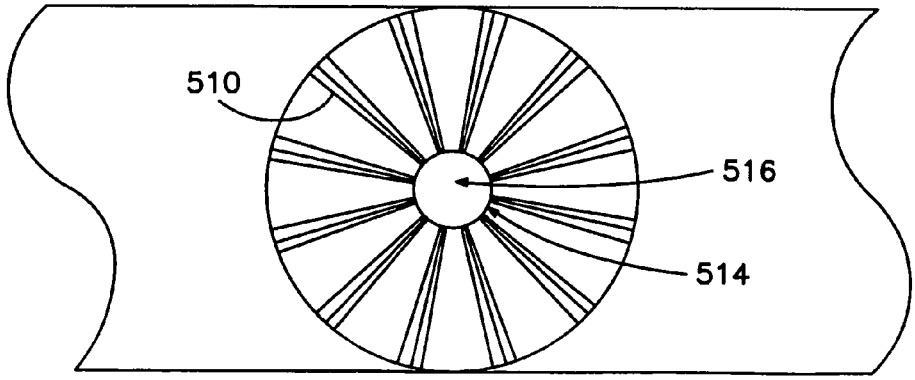
FIG. 53 is an elevation of the other component of the ratcheting mechanism of FIG. 51.

In FIGS. 51-53, the matching pair of ratchet structures includes, on one of the mating surfaces, a "female" structure of twelve (although a higher or lower number could be used) radiating ribs 500, that are set in a recess 502, concentrically surrounding a cylindrical post 504. Each of ribs 500 preferably has a triangular cross-section that preferably increases in height and width, with distance from the center 506. On the other mating surface, a "male" structure of twelve (although a like higher or lower number could be used) radiating ribs 510, that are set on a raised circular pedestal 512, concentrically surrounding a cylindrical bore or aperture 514. Each of ribs 510 likewise preferably has a triangular cross-section that is the same as that of corresponding ribs 500, which preferably increases in height and width, with distance from center 516. Ribs 500 and 510 will be preferably uniformly circumferentially spaced around their respective centers 506, 516, with ribs 510 being offset by, e.g., 15°. When the surfaces are mated, post 504 will be insertingly received in bore or aperture 514, to help keep the surfaces aligned. The ratcheting action is as described with respect to FIGS. 42-44.

Figure 54A:
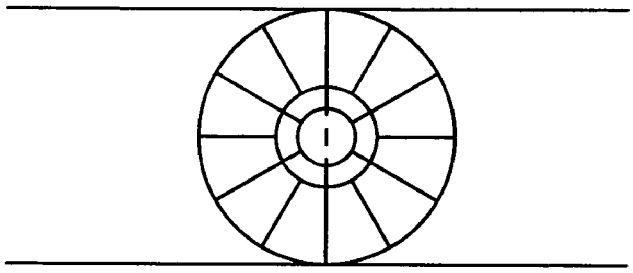
FIG. 54A is a schematic illustration of a possible ratchet surface configuration.
Figure 54B:
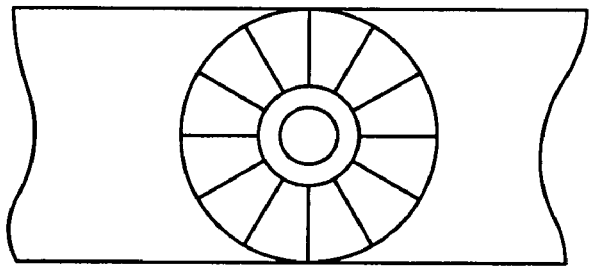
FIG. 54B is another schematic illustration of a possible ratchet surface configuration.
Figure 54C:
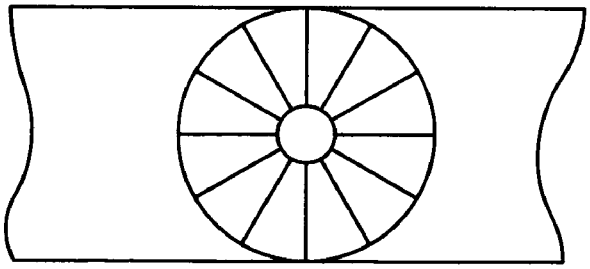
FIG. 54C is another schematic illustration of a possible ratchet surface configuration.
Figure 54D:
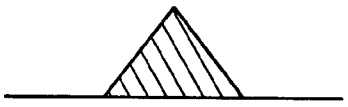
FIGS. 54D-54L are further schematic illustrations of possible ratchet surface cross-sectional configurations.
Figure 54E:
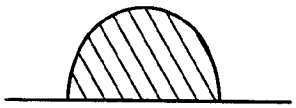
Figure 54F:
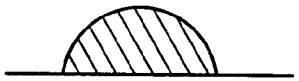
Figure 54G:
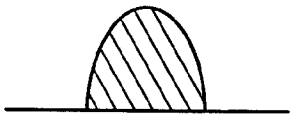
Figure 54H:
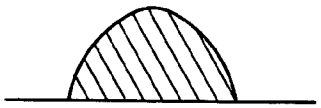
Figure 54I:
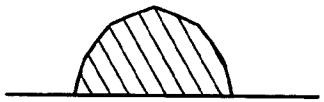
Figure 54J:
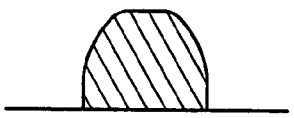
Figure 54K:
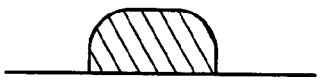
Figure 54L:
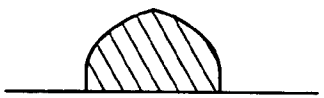
Figure 55:
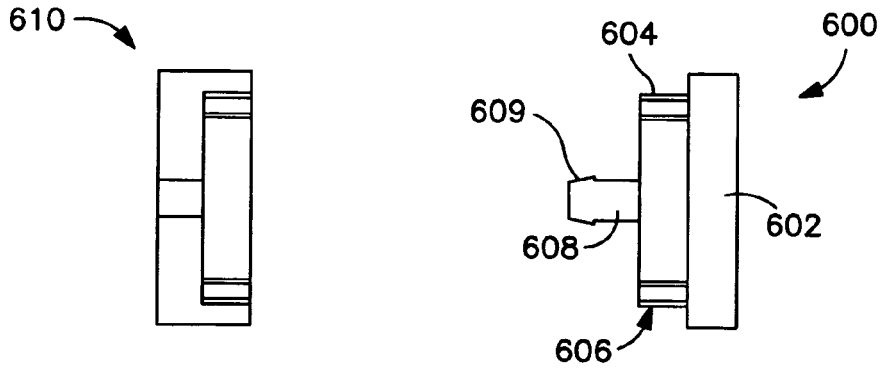
FIG. 55 is a side elevation, in section, showing the functional components of a ratchet mechanism in the interface between the frame parts and the indexes, according to an alternative embodiment of the present invention, taken along lines 55-55 in FIGS. 56 and 57, respectively.
Figure 57:
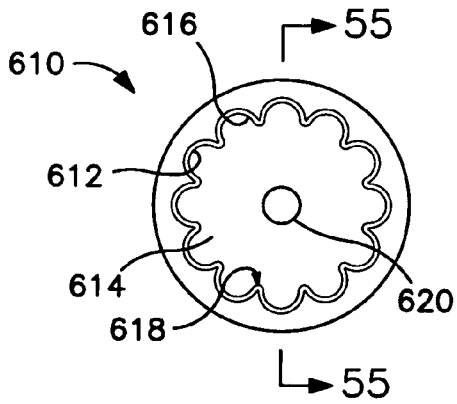
FIG. 57 is a front elevation of the other component of the ratchet mechanism of FIG. 55.
Figure 56:
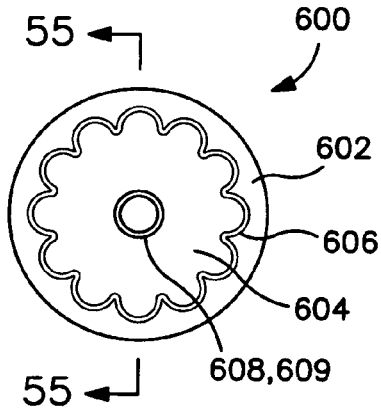
FIG. 56 is a front elevation of one component of the ratchet mechanism of FIG. 55.
Figure 59:
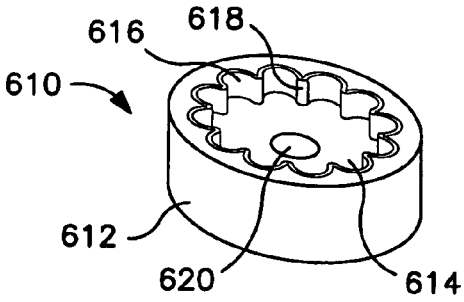
FIG. 59 is a perspective view of the component of FIG. 57.
Figure 58:
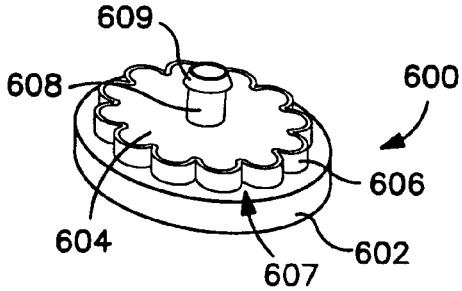
FIG. 58 is a perspective view of the component of FIG. 56.

FIGS. 54A-54C illustrate schematically that the particular configuration of the ratchet structure, including the number of radiating ridges (indicated by the radiating lines), whether the ridges extend completely or partially from the center to the outer periphery, and whether there may be more than one concentric feature (like a post or a bore) that may or may not have ridges on it, can be widely varied by one of ordinary skill in the art, having the present disclosure before them, without departing from the scope of the invention.

FIGS. 54D-54L illustrate some of the possible various cross-sectional configurations that the ridges of the ratchet structures may have, including but not limited to: triangle; half-circle; half-ellipse (width=long axis); half-ellipse (width=short axis); polygon with flat crest; polygon with peaked crest; and three combined curve and straight line configurations, both flat topped and peaked, respectively (often called "obrounds"). In each case, whatever ridge cross-section is selected, it is understood that for the ridges of two opposing ratchet surfaces to interdigitate well, the cross-sections preferably increase in height and width, with distance from the center of the ratchet surface to the periphery.

With each of the ratchet structures described hereinabove, the cross-sectional shape of the ribs may be modified to, for example, semicircular shapes or semi-elliptical shapes, as may be desired. Also, because the ribs extend in complete circles, relative rotation of the components is only limited by any obstructions external to the ratchet structures. In the present invention, as can be seen from the other drawings, the range of pivoting movement is clearly quite large, being the substantial majority of a complete circle in each illustrated embodiment.

Although ratchet structures are preferred for providing rotational control of the frame parts relative to the indexes and to each other (in the case of multiple connected frame parts), it is contemplated that other (usually friction or interference-based) types of rotational control structures may be provided, that are based upon the principle that resistance (up to a certain torsional value) is exerted, so that the frame structure can be pivoted to a desired position, and reliably remain in that desired position, during normal use conditions, until moved again by the user.

FIGS. 55-63 illustrate functional components for additional alternative ratchet structures. Unlike the previously described ratchet structures of FIGS. 42-44, in which the ribs extend radially from the center of the ratchet structure and make contact and exert force substantially in a direction parallel to the axis of rotation of the index or frame part, the complementary engaging structures of FIGS. 55-63 extend circumferentially and make contact and exert force in a radial direction.

FIGS. 55-59 illustrate one combination of complementary ratchet rotational control structures, according to a preferred alternative embodiment of the invention. The functional components include a male component 600 and a female component 610. Male component 600 includes base 602, which may be molded into, or extending outwardly from one of the mating surfaces (not shown). From base 602, contoured projecting portion 604, includes a plurality of convex ridges 606, arranged circumferentially about central post 608, which may be provided with a barb 609. Female component 610 likewise includes a base 612, which may be molded into, or extending outwardly from the other of the mating surfaces (not shown). From base 612, contoured recess 614 includes a plurality of concavities 616, separated by crests 618. Centered in recess 614 is aperture 620.

In operation, when the mating surfaces are brought together, such as when a frame component is attached to an index, male component 600 (which may be on the frame) is insertingly received in recess 614 of female component 610 (which may be on the side of the index). Central post 608 (and flexible/resilient barb 609) is received in aperture 620. If a barb 609 is provided, there will be provided an enlarged cavity "behind" aperture 620, to accommodate barb 609, so that barb 609 serves to lock the two structures together. At least a portion of projecting portion 604 will be insertingly received in recess 614. Preferably, the fit between projecting portion 604 and the inside surfaces of recess 614 will be close, but not tight, so that if sufficient torque is applied to the components connected to the respective mating surfaces, the material of components 600 and 610 will distort (without breaking or permanent deformation) sufficient to permit the crests 618 to ride up on the sides of ridges 606, and then snap into the next adjacent troughs 607 between ridges 606. Preferably, the material(s) from which components 600 and 610 are made, will be sufficiently flexible and resilient that the ratcheting action will not require excessive force, but will be strong enough that the structures will remain in their new positions (even when tools are loaded) until acted upon again by a sufficiently strong enough intentionally applied torsional force, and not wear down over the course of a reasonable expected lifespan of the overall device.

It is to be understood that the amount of curvature, and the proportions and dimensions of the complementary surfaces may be varied depending upon the requirements of the particular application. The shapes of the complementary surfaces likewise may be varied as desired. By making the forces to be exerted/overcome to move the respective structures extend in the radial direction, it is believed that a more reliable ratchet action, and more reliable position-holding capability will be provided, as compared to the ratchet structure of FIGS. 42-44.

Figure 61:
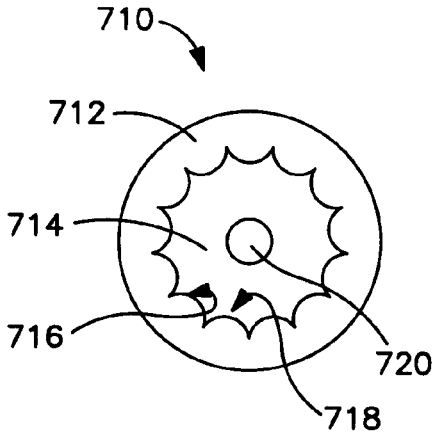
FIG. 61 is an elevation of an alternative ratchet component, which is complementary to the component of FIG. 60.
Figure 60:
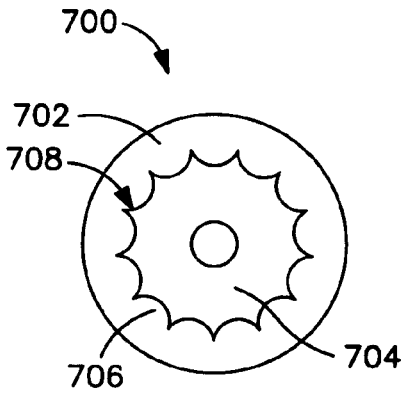
FIG. 60 is an elevation of an alternative ratchet component.

FIG. 60 is an elevation of an alternative ratchet component. FIG. 61 is an elevation of an alternative ratchet component, which is complementary to the component of FIG. 60. As can be seen, the components of FIGS. 60, 61 are functionally the reverse of those of FIGS. 55-59. It is to be understood that each of these components may be either molded into or extending from the surfaces the respective mating surfaces of the structures to be pivotably, but restrainably, connected. Male component 700 includes base 702, concave contoured projecting portion 704, having concavities 706 and crests 708, and central post 708 (which may include a barb, not shown). Female component 710 includes base 712, recess 714, a plurality of convex projections 716, separated by notches 718, all surrounding a central aperture 720. The operation of components 700, 710 (once their respective mating surfaces have been brought together, concave contoured projecting portion 704 being insertably received into recess 714, and center post 708 inserted into central aperture 720), is analogous to the operation of components 600, 610.

Figure 63:
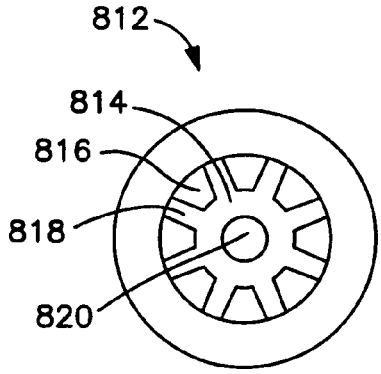
FIG. 63 is an elevation of an alternative ratchet component, which is complementary to the component of FIG. 60.
Figure 62:
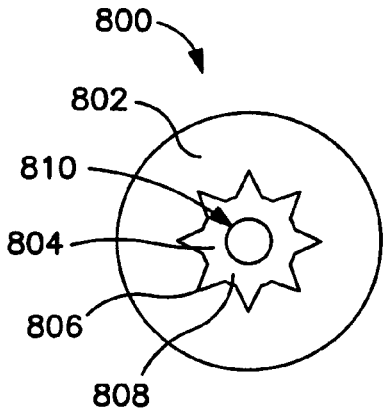
FIG. 62 is an elevation of an alternative ratchet component.

Depending upon such factors as the hardness(es) of the material(s) from which the ratchet components are made, the structures which interface in the ratchet structures, need not be rounded, but can be more angular in cross-section, as shown in FIGS. 62-63.

It is to be understood further that while the male ratchet components have been described and illustrated as having the projecting posts that are received in the apertures of the female ratchet components, in alternative embodiments, the apertures may be disposed on the male ratchet components and the center posts disposed on the female ratchet components.

FIG. 62 is an elevation of an alternative ratchet component. FIG. 63 is an elevation of an alternative ratchet component, which is complementary to the component of FIG. 60. Male component 800 includes base 802, spiked projection portion 804 with radial spikes 806 and gaps 808, and central post 810. Female component 812 includes base 814, recess 816, radially inwardly projecting teeth 818, gaps 820, and central aperture 822. Again, upon bringing the mating surfaces together, portion 804 is insertably received in recess 816, and center post 810 is received in aperture 822. Spikes 806 will fit into gaps 820, and teeth 818 will fit into gaps 808. The ratchet operation, again, will be similar to that described with the other embodiments of FIGS. 55-59 and 60-61.

Again, it will be understood that the contours of the projections on the male components and the contours of the surfaces of the recesses of the female components are shown by way of example, and the invention is not intended to be limited thereto, as other complementary constructions may be employed, without departing from the scope of the invention.

Figure 64:
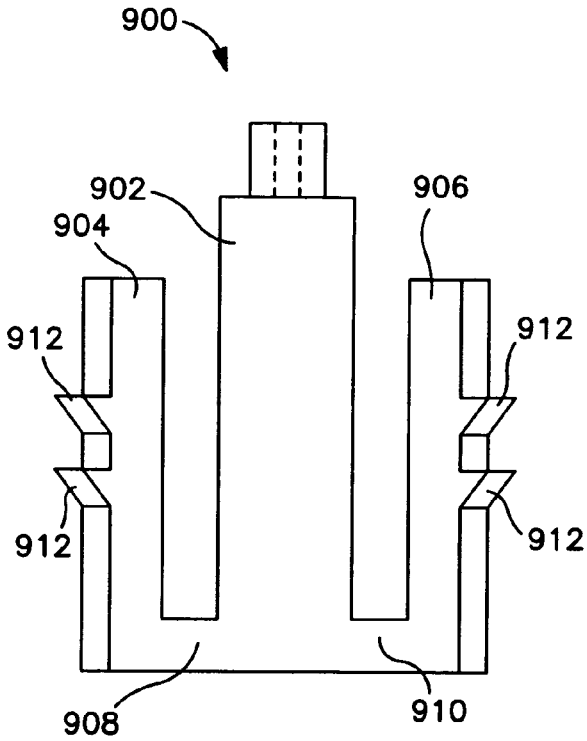
FIG. 64 is a front elevation of a retaining pin according to an alternative preferred embodiment of the invention.
Figure 65:
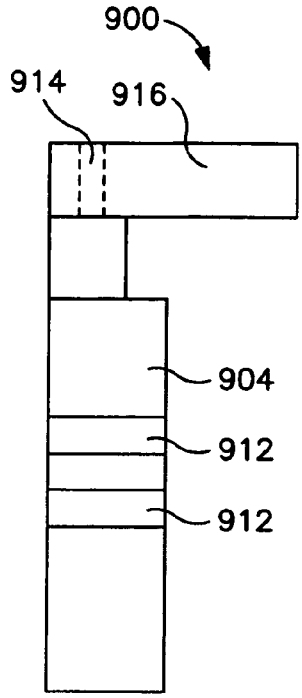
FIG. 65 is a side elevation of the retaining pin according to the embodiment of FIG. 64.
Figure 66:
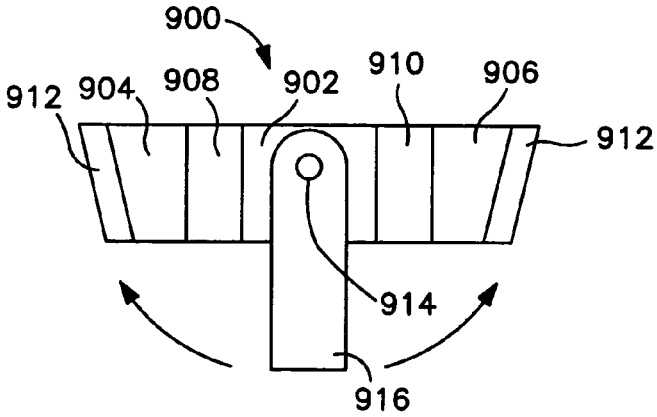
FIG. 66 is a top plan view of the retaining pin according to the embodiment of FIG. 64.

FIGS. 64-66 illustrate an alternative construction for the retaining pins used for holding down the frames and/or the indexes (if pivotable). Retaining pin 900 includes a central post 902, and two side legs 904, 906, and is configured to have a trapezoidal "footprint" as seen from above in FIG. 66, so as to fit into one of trapezoidal slots, e.g., slot 164, as described hereinabove. Legs 904, 906 are joined to post 902 by webs 908, 910, and have wedge-shaped teeth 912 extending laterally from their outwardly-directed faces. Preferably, retaining pin 900 is slightly wider than the width of the slot into which it will be forcibly fitted, so that legs 904, 906 will be deflected slightly toward one another, and teeth 912 will frictionally engage the adjacent inside surfaces of the slot, to hold it in place. Center post 902 will have a pin 914 extending upwardly from its top surface, upon which retaining arm 916 will be pivotably mounted (see arrows in FIG. 66), preferably with sufficient frictional resistance against pivoting, that retaining arm 916 will not be loose, but will pivot under moderate pressure from one side.

The structures of the rack and frame parts may be modified considerably, and if suitably dimensioned and provided with mating rotational control surfaces, swapped or interchanged as prompted by the requirements of a given application, to accommodate tool parts of various sizes and shapes, without departing from the scope of the invention, and the present invention is not limited to those particular embodiments illustrated herein.

FIGS. 67-70 illustrate the components of an index, incorporating an alternative ratchet structure, according to an embodiment of the present invention, which is related to the ratchet structure of FIGS. 55-62.

Figure 67:
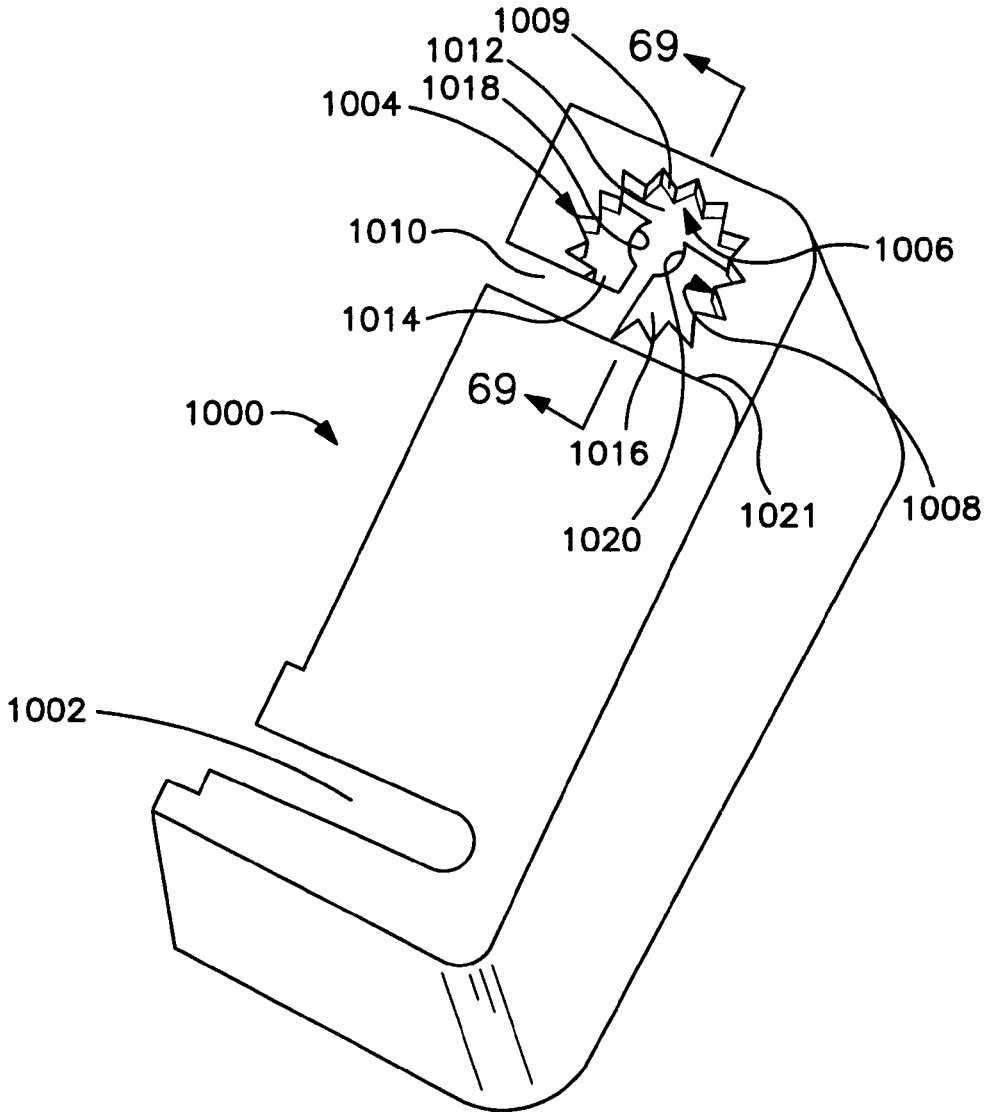
FIG. 67 is a perspective view of an index lower portion, bearing a "female" ratchet portion according to an embodiment of the present invention.

FIG. 67 is a perspective view of an index cover part 1000, which may be otherwise similar in structure and function, to the indices shown hereinabove, e.g., index cover part 116 of FIG. 2. Index cover part 1000 includes notch 1002 at one end (a similar notch is located at the other end, which is provided to receive an inwardly extending post (discussed in further detail hereinafter), which would be provided in the corresponding case part (analogous to case parts 102, 104 of FIG. 1), in which the index cover part 1000 would be received.

Index cover part 1000 is also provided, at each end, with a female ratchet structure 1004, which is analogous in structure and function to the female ratchet structures 610 (of FIG. 55), 710 (of FIG. 61) and 812 (of FIG. 63). Female ratchet structure 1004 is in the form of a generally star-shaped recess, with a periphery having a plurality of triangle- or spike-shaped outwardly radiating notches 1006 or, looked at another way, inwardly radiating projections 1008, the notches or projections being formed by a series of planar, generally rectangular, faces 1009.

Figure 68:
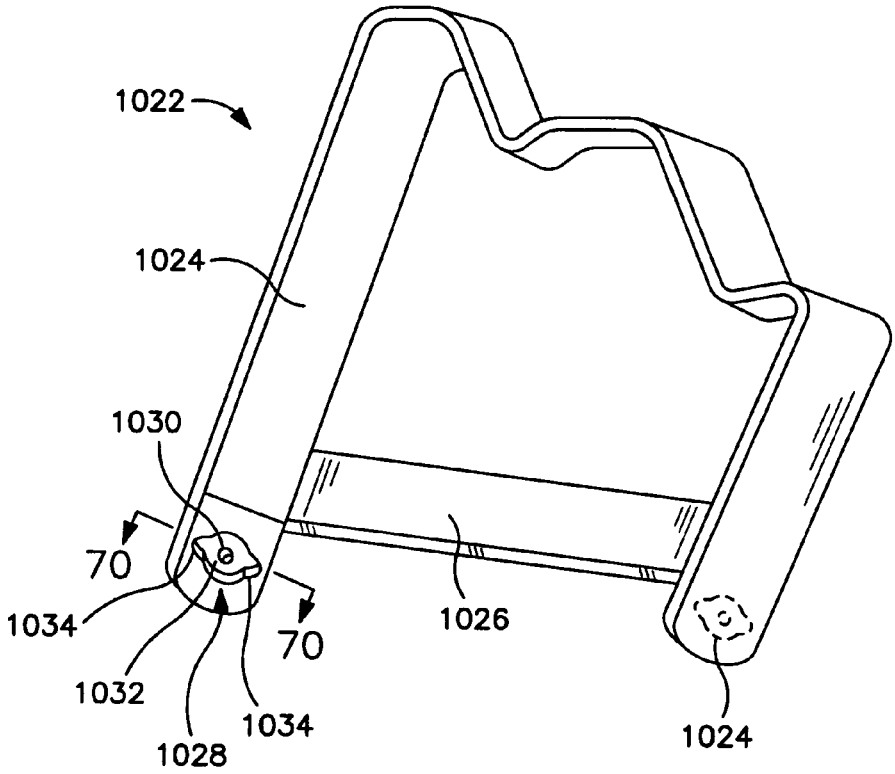
FIG. 68 is a perspective view of an index frame portion, bearing a "male" ratchet portion, according to the embodiment of the invention of FIG. 67.
Figure 69:
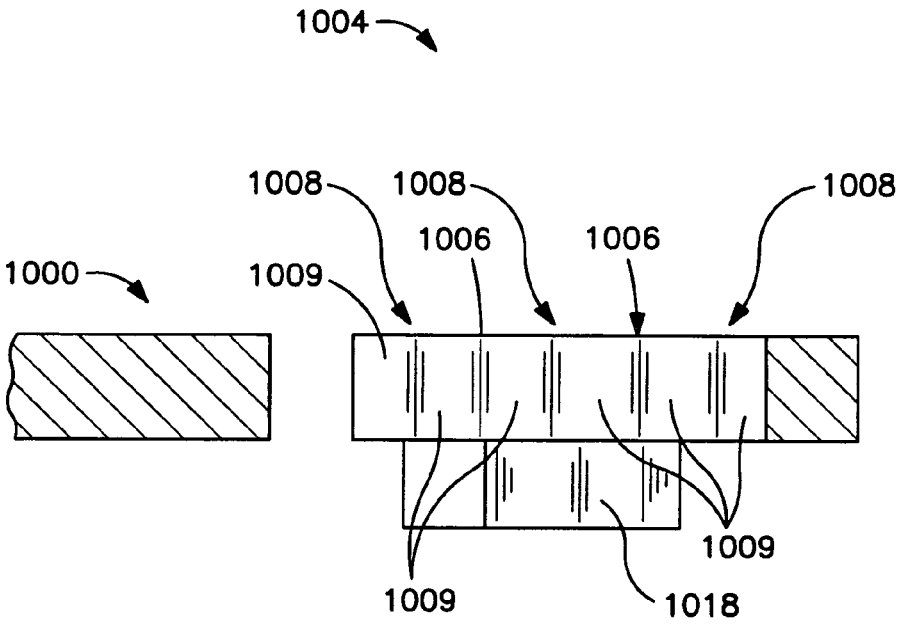
FIG. 69 is a side elevation, partially in section, of the female ratchet portion, taken along line 69-69 of FIG. 67.
Figure 70:
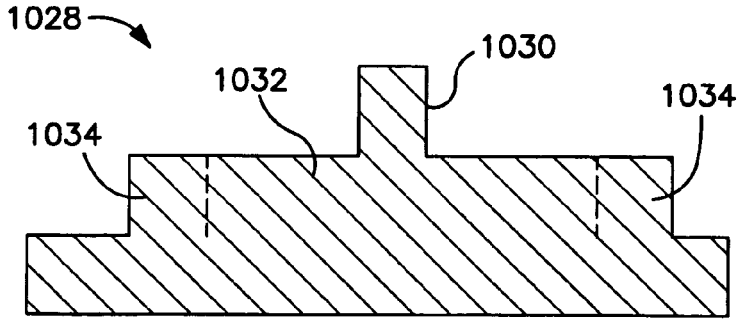
FIG. 70 is a side elevation, in section, of the male ratchet portion, taken along lines 70-70 of FIG. 68.
Figure 74:
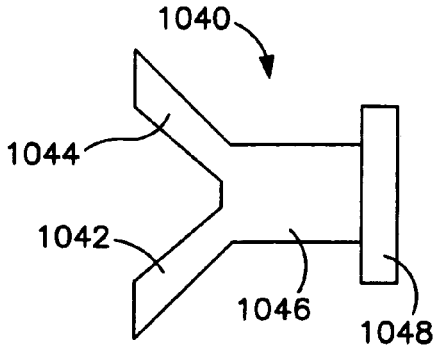
FIG. 74 is a top plan view thereof.
Figure 73:
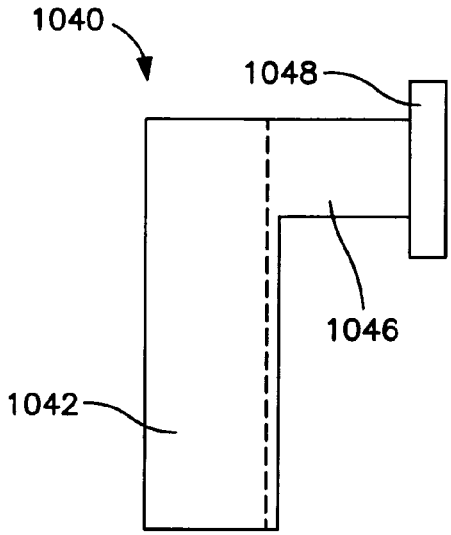
FIG. 73 is a side elevation thereof.
Figure 71:
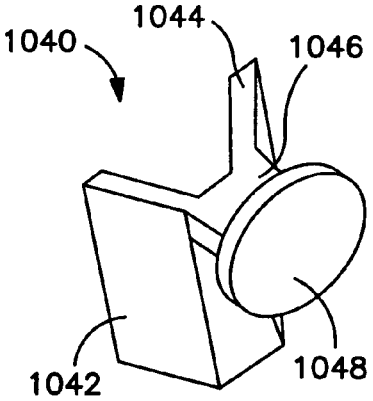
FIG. 71 is a perspective view of a pivot pin according to an alternative embodiment, of the present invention.
Figure 72:
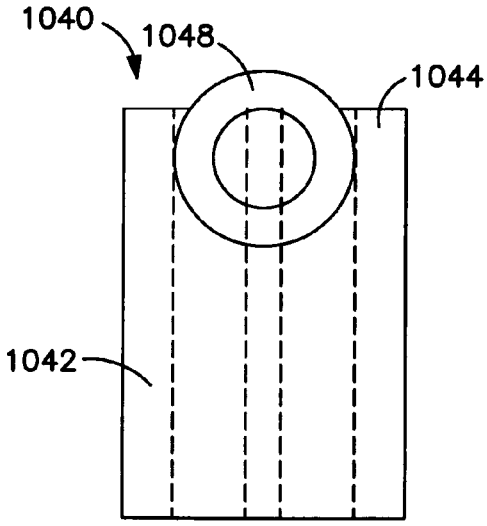
FIG. 72 is a front elevation thereof.

In a preferred embodiment of the invention, the material of index cover part 1000 surrounding the star-shaped recess is partially interrupted, by a gap 1010. This is because preferred embodiments of the invention will be fabricated from plastic or plastic-like materials, and formed such as by injection molding or similar processes, and by providing a gap 1010, the molding process may be made easier, as will readily be recognized by one of ordinary skill in the art of plastic molding processes, having the present disclosure before them. For similar reasons, the "bottom" of the recess may, in fact also be perforated in parts, such as at 1012. Thus, the "bottom" of the recess may be formed by two webs 1014, 1016, which are "below" or to the inside of, the recess (as shown in FIG. 68). Web 1014 includes a concave arcuate surface 1018, and web 1016 includes a concave arcuate surface 1020, which arcuate surfaces 1018, 1020 together form a space, analogous to aperture 620 (of FIG. 57), for receiving the projecting post 1030 (FIGS. 68, 70) of the male ratchet portion 1028.

In alternative embodiments of the invention (not shown), for example, in which other manufacturing methods permit the index cover part to have a more solid structure, the gaps, such as 1010 and 1012, may be omitted, and the area around female ratchet structure 1004 may be more "solid", save for the aperture for receiving the post of the male ratchet portion, which would still need to be a through aperture (if the post has a barbed portion), or which may be a blind bore (if the post lacks a barbed portion).

FIG. 68 illustrates a frame part 1022, having a web 1024, and a supporting cross brace 1026, and male ratchet portion 1028. A similar male ratchet portion, to that illustrated, is located on the opposite inside surface of the web 1024, and is shown in broken lines. Male ratchet portion 1028 includes post 1030, contoured projecting portion 1032, which includes, in the embodiment of FIGS. 67-70, two radially outwardly extending triangular projections 1034, which are located 180° apart. In alternative embodiments, a greater number of projections may be provided (being still less than the total number of notches provided in the female ratchet portion)—so long as each projection provided will be received in one of the notches, at any given position of the frame with respect to the index cover part, or even only one projection, so long as post 1030 is provided, to keep male ratchet portion 1028 centered, relative to female ratchet portion 1004.

When frame part 1022 is snapped onto index cover part 1000 (both components preferably being fabricated from a resilient material of at least some flexibility), male ratchet portions 1028 are inserting received into female ratchet portions 1004, with projections 1034 being received in oppositely located ones of the notches 1006, between respective adjacent pairs of projections 1008. The clearance between projections 1034, and faces 1009 will be such that preferably, there will be a limited amount of "play", and frame part 1022 will tend to remain in any given rotational orientation, relative to index cover part 1000, unless a fairly substantial torsional force is exerted on either frame part 1022 and/or index cover part 1000, to overcome the interference resistance created between the tips of projections 1008, and the tips of projections 1034. However, once enough force is applied, the respective contacting structures of the male and female ratchet structures will momentarily deflect enough to enable the frame to be incrementally pivotably moved, relative to index cover part 1000, and the ratcheting motion will continue, until either the force is removed, or the frame has reach the limits of its available pivoting movement relative to index cover part 1000 (which limits will, in a preferred embodiment, be about 90°±, as caused by the presence of rounded, outwardly projecting shoulders 1021).

As with the other previously described embodiments, the notches and projections of the female ratchet portion may have contours which are other than triangular (such that faces 1009 may be other than planar, such as convex or concave, or broken into plural planar faces), and the projection(s) of the male ratchet portion likewise may be other than triangular, and have side(s) that are planar, convex or concave or broken into plural planar faces.

The construction of the embodiment of FIGS. 67-70, comprises an application of, and a simplification of, the principles of the structures of the embodiments of FIGS. 55-62, and is believed to represent an improvement in terms of manufacturability.

The embodiment of FIGS. 67-70 also includes additional distinctive structures. As noted earlier, index cover part 1000 includes slots 1002, located at both ends of the cover part. Index cover part 1000 is configured to receive inwardly extending posts, which are cooperatively engaged, in a manner to be described hereinafter) with the wedge-shaped slots of the case (e.g., slots 161), which are an enhancement of the pivot pins 160 described hereinabove. FIGS. 71-74 illustrate pivot pin 1040, which includes wings 1042, 1044, which are angled so as to fit, with a moderate frictional resistance, into a slot in a case, such as slots 161. Pivot pin 1040 also includes stem 1046, which is preferably generally cylindrical and has a diameter which is less than the height of slot 1002, and head 1048, which preferably is disc-shaped and has a diameter which is greater than the height of slot 1002.

In practice, when an index is being assembled, using index cover part 1000, two pivot pins 1040 are inserted, along stems 1046, into each of slots 1002, such that heads 1048 are on the inside of index cover part 1000. The index is completed by snap-fitting onto index cover part 1000 a mating index cover part, similar or analogous to index cover part 128 of FIG. 3. After the mating index cover part has been snapped onto cover part 1000, then the assembled index and frame part (or parts) is lowered into a case part, with pivot pins 1040 being inserted into opposing slots 161.

The present invention also includes an alternative embodiment of the retaining pin of FIGS. 64-66. Retaining pin 1100 includes wedge-shaped post 1102, which is configured to have a trapezoidal "footprint" as seen from above in FIG. 76, so as to fit into one of trapezoidal slots, e.g., slot 164, as described hereinabove. Post 1102 includes wings 1104 and 1106, joined by web 1110. Post 1100 has square pin 1112, topped by square block 1114. Attached to post 1102 is retaining arm 1116, which includes slot 1118, which preferably fits with a friction fit onto pin 1112. Retaining arm 1116 includes leg 1120, which can flex, slightly, when a lateral force is exerted on arm 1116, which would tend to cause arm 1116 to pivot around pin 1112, to enable arm 1116 to be moved from a position blocking the index or frame, to a position which clears the index or frame, to permit the index or frame to be moved.

Figure 75:
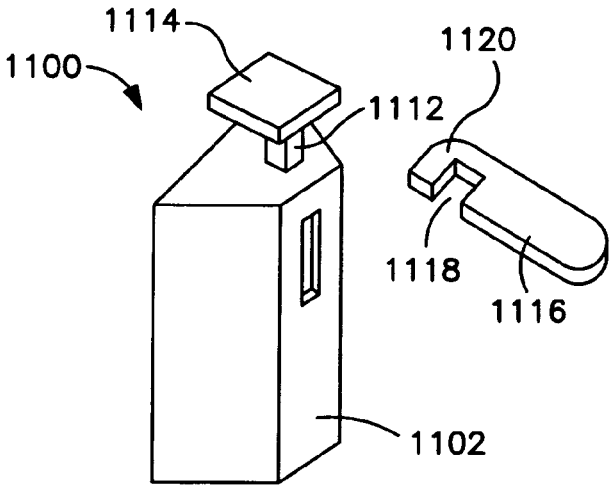
FIG. 75 is a perspective, exploded, view of a retaining pin according to an embodiment of the present invention.
Figure 76:
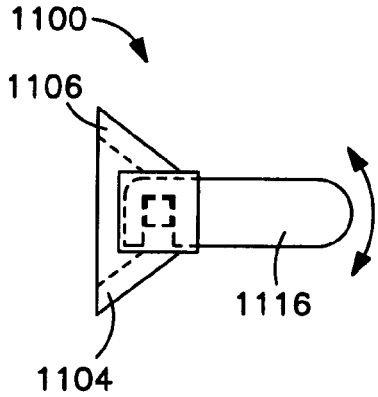
FIG. 76 is a top plan view thereof.
Figure 77:
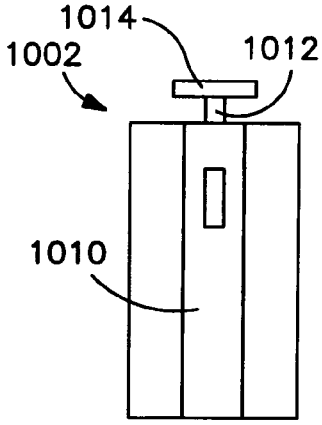
FIG. 77 is a front elevation of the post for the retaining pin of FIG. 75.
Figure 78:
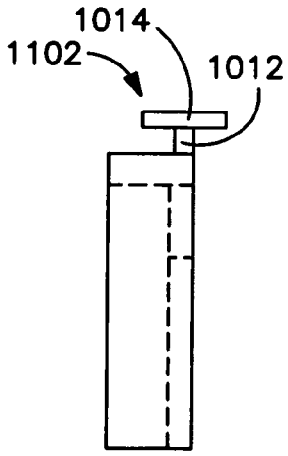
FIG. 78 is a side elevation thereof.
Figure 79:
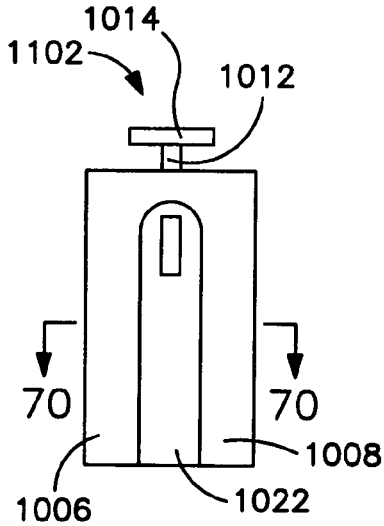
FIG. 79 is a rear elevation thereof.
Figure 80:
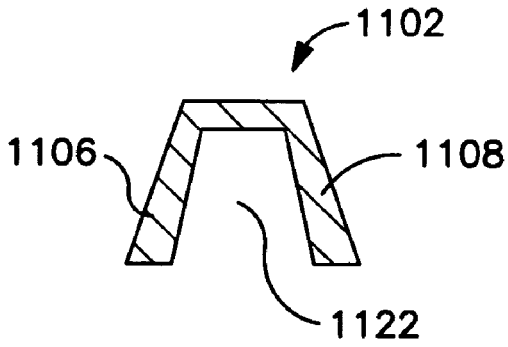
FIG. 80 is a sectional view taken along line 80-80 of FIG. 79.
Figure 81:
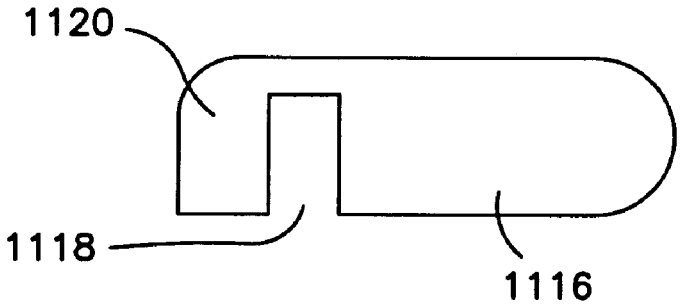
FIG. 81 is a plan view of the retaining arm of FIGS. 75, 76.
Figure 82:
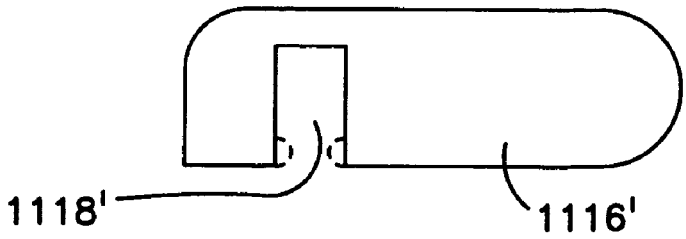
FIG. 82 is a plan view of a retaining arm according to an alternative embodiment of the invention.

In the embodiment of FIGS. 75 and 76, post 1102 is, as mentioned, provided with two "wings" 1106 and 1108, which define a vertical open space 1122. In an alternative embodiment, post 1102 may be formed without any internal voids, so as to provide a solid post, which may be stronger, more durable and/or stiffer. In addition, in the embodiment of FIGS. 75, 76, retaining arm 1116 is provided with slot 1118, which is completely rectangular, as seen in FIG. 81. In an alternative embodiment, shown in FIG. 82, for retaining arm 1116', the opening to slot 1118' may be narrower than the interior portion of slot 1118', so that only in the interior portion of slot 1118' are the sides of the slot parallel. In this way, the "grip" of retaining arm 1116' on a pin 1112 can be made tighter. The portions of the sides of slot 1118' that narrow toward the opening can be slightly curved, as shown in FIG. 82, or straight and angling toward one another, and/or small bumps may be provided to make the entry to slot 1118' narrower (see broken lines).

While the present invention is described and illustrated with particular reference to the environment of a drill bit case, in which the indexes and frames (and the bits they hold) occupy substantially the entire interior of the two-piece hinged case parts, it is to be understood that the modular tool holding structure can be applied to other types of tool and part holding cases, such as general multi-part tool cases, in which other tools (both hand and/or power tools) are also contained in the same case, along with the index and frame structure. One or more indexes may be accommodated in each side of a case, as space permits. In addition, the case does not have to be a two-piece hinged case type or even a hinged type to accommodate or take advantage of the present invention. For example, a simple rectangular parallelepiped case, having a snap or slide-on lid can also be adapted, so long as it has the interior structures (e.g., the pegs for defining the slots) for receiving the pivot pins of one or more indexes, and optionally for holding the retaining pins.

The packaging, storage and display apparatus and system of the present invention has many advantages for a manufacturer of goods such as tool and parts kits, as well as a private consumer, in that by being able to select from a variety of racks and a variety of frame structures, gives a manufacturer or individual consumer the flexibility to design and assemble a tool case, to the particular specifications of the particular manufacturer or individual consumer. In addition, the movable and positionable frame structures permit the user of the tools to open the case and position the tools in a desired work orientation that is most suitable to the needs and/or tastes of the particular user. In addition, through the use of the pegs in the case interiors, which define the trapezoidal slots that receive the pivot pins of the indexes, a consumer (whether private or a business consumer) may have a number of different index/frame structures holding different tool bits or parts, which different index/frame structures can be switched in and out of a case, as desired or required by the needs of the user.

In addition, by providing the pivoting one- or two-piece (or more) frames that are pivotable with respect to the index, the index can be removed from a case and set up as a free-standing index, out of its case, by moving the frame around to hold up the index. For this reason, the indexes of the preferred embodiment have solid, unbroken front and back parts, in part to provide a complete finished look, as well as to provide space for indicia indicating the sizes of the respective tools held in the index, if desired. Thus, in commercial embodiments of the invention, tool cases can be sold with selected indexes in them, and indexes and frames of various sizes can be sold separately, or in various combinations.

The foregoing description and drawings merely explain and illustrate the invention, and the invention is not limited thereto, except as those skilled in the art who have the present disclosure before them will be able to make modifications and variations therein without departing from the scope of the invention.

What is claimed is:

1. A holder for packaging, storing and displaying articles, comprising: at least one index having positioned therewithin a rack which is operably configured to engage and releasably retain an end of at least one article;

a frame structure pivotably mounted to the index;

rotation control structure interconnecting the frame structure and the index for providing resistance to relative rotation between the frame structure and the index until a torsional force in excess of a predetermined amount of torsional force is anplied between the frame structure and the index, whereupon relative pivoting of the frame and index is enabled, and whereupon removal of the torsional force, which is in excess of the predetermined amount of torsional force, the frame structure and the index will remain in position relative to each other;

wherein the at least one index comprises a first index cover part having interior structures therein configured for guiding and receiving the rack;

a second index cover part configured to matingly join the first index cover part to capture the rack between the first index cover part and the second index cover part.

2. The holder for packaging, storing and displaying articles according to claim 1, wherein the frame structure comprises:

a web of material, one end of which is connected to and extends from one end of the at least one index for a predetermined distance, across the width of the at least one index and proceeds at the other end of the web, to the other end of the index, to form a loop which encloses a defined space between the frame structure and the index, within which the articles received by the index are to be positioned.

3. The holder for packaging, storing and displaying articles according to claim 1, wherein the frame structure is selected from a plurality of frame structures having different shapes and configurations for defining different shapes and areas of spaces between the webs of the frame structures and the index, when each of the frame structures is mounted on the index.

4. The holder for packaging, storing and displaying articles according to claim 1, wherein the frame structure includes at least one surface which engages with a corresponding mating surface of the at least one index, and the rotation control structure comprises mating ratchet structures disposed on the at least one surface of the frame structure and the corresponding mating surface of the at least one index.

5. A packaging, storage and display apparatus for articles, comprising:

a case having at least one case section that defines an interior volume for receiving articles;

at least one index pivotably mounted in the at least one case section, the at least one index being pivotably movable between a stowed position within the at least one case section, and a deployed position;

the at least one index being operably configured to receive and retain an end of at least one article;

a frame structure pivotably mounted to the index;

rotation control structure interconnecting the frame structure and the index, operably configured to enable at least one portion of the frame structure to remain in a first position relative to the index until a force greater than a predetermined amount is applied, prompting the at least one portion of the frame structure to move to one of a plurality of possible second positions relative to the index, and to further enable the at least one portion of the frame structure to remain in the one of a plurality of second positions upon removal of the force, wherein the frame structure includes at least one surface which engages with a corresponding mating surface of the at least one index, and the rotation control structure comprises mating ratchet structures disposed on the at least one surface of the frame structure and the corresponding mating surface of the at least one index;

the frame structure being operably configured to inhiblt removal of the at least one article from the at least one index when the at least one portion of the frame structure is in the first position, the frame structure being further operably configured to provide support to the at least one index when the at least one index is in the deployed position, and the at least one portion of the frame structure is in one of the plurality of possible second positions.

6. The packaging, storage and display apparatus for articles according to claim 5, wherein the rotation control structure comprises:

at least one male ratchet member, disposed on one of the frame structure and the index, and having an first axis of pivoting, and a projecting contoured portion with contoured ratchet surfaces disposed circumferentially about the first axis of pivoting on a radially outwardly facing surface of the projecting contoured portion;

at least one female ratchet member, disposed on the other of the frame structure and the index, and having a second axis of pivoting, and a recess centered on the axis of pivoting, and a plurality of complementary contoured ratchet surfaces disposed circumferentially about the second axis of pivoting on a radially inwardly facing surface of the recess;

the at least one first male ratchet member being insertably received in the at least one female ratchet member, the first axis of pivoting being disposed coaxially with the second axis of pivoting.

7. The packaging, storage and display apparatus for articles according to claim 6, wherein the contoured ratchet surfaces of the male ratchet member comprise a plurality of convex projections.

8. The packaging, storage and display apparatus for articles according to claim 6, wherein the plurality of complementary contoured ratchet surfaces of the female ratchet member comprise a plurality of concavities.

9. The packaging, storage and display apparatus for articles according to claim 6, wherein the contoured ratchet surfaces of the male ratchet member comprise a plurality of concavities.

10. The packaging, storage and display apparatus for articles according to claim 6, wherein the plurality of complementary contoured ratchet surfaces of the female ratchet member comprise a plurality of convex projections.

11. The packaging, storage and display apparatus for articles according to claim 6, wherein the plurality of complementary contoured ratchet surfaces of the female ratchet member and the contoured ratchet surfaces of the male ratchet member comprise complementary sets of radially extending projections.

12. A packaging, storage and display apparatus for articles, comprising:

a case having at least one case section that defines an interior volume for receiving articles;

at least one index pivotably mounted in the at least one case section, the at least one index being pivotably movable between a stowed position within the at least one case section, and a deployed position;

the at least one index being operably configured to receive and retain an end of at least one article;

a frame structure pivotably mounted to the index;

rotation control structure interconnecting the frame structure and the index, operably configured to enable at least one portion of the frame structure to remain in a first position relative to the index until a force greater than a predetermined amount is applied, prompting the at least one portion of the frame structure to move to one of a plurality of possible second positions relative to the index, and to further enable the at least one portion of the frame structure to remain in the one of a plurality of second positions upon removal of the force, wherein the frame structure includes at least one surface which engages with a corresponding mating surface of the at least one index, and the rotation control structure comprises mating ratchet structures disposed on the at least one surface of the frame structure and the corresponding mating surface of the at least one index;

the frame structure being operably configured to inhibit removal of the at least one article from the at least one index when the at least one portion of the frame structure is in the first position, the frame structure being further operably configured to provide support to the at least one index when the at least one index is in the deployed position, and the at least one portion of the frame structure is in one of the plurality of possible second positions, wherein the rotation control structure comprises:

at least one male ratchet member disposed on one of the frame structure and the index, and having an first axis of pivoting, and a projecting contoured portion with at least one contoured ratchet surface disposed perpendicular to the first axis of pivoting on a radially outwardly facing surface of the projecting contoured portion;

at least one female ratchet member disposed on the other of the frame structure and the index, and having a second axis of pivoting, and a recess centered on the axis of pivoting, and a plurality of complementary contoured ratchet surfaces disposed circumferentially about the second axis of pivoting on a radially inwardly facing surface of the recess;

the at least one first male ratchet member being insertably received in the at least one female ratchet member, the first axis of pivoting being disposed coaxially with the second axis of pivoting.

13. The packaging, storage and display apparatus for articles according to claim 12, wherein the at least one contoured ratchet surface of the male ratchet member comprises a generally triangular projection.

14. The packaging, storage and display apparatus for articles according to claim 13, wherein the plurality of complementary contoured ratchet surfaces of the female ratchet member comprise a plurality of concavities.

15. The packaging, storage and display apparatus for articles according to claim 12, wherein the at least one contoured ratchet surface disposed perpendicular to the first axis of pivoting on a radially outwardly facing surface of the projecting contoured portion, comprises two contoured ratchet surfaces disposed at opposing positions, on opposed outwardly fading surfaces of the projecting contoured portion.

16. The packaging, storage and display apparatus for articles according to claim 15, wherein the two contoured ratchet surfaces comprise two triangular radially outwardly extending projections.

17. A packaging, storage and display apparatus for articles, comprising:

a case having at least one case section that defines an interior volume for receiving articles;

at least one index pivotably mounted in the at least one case section, the at least one index being pivotably movable between a stowed position within the at least one case section, and a deployed position;

the at least one Index being operably configured to receive and retain an end of at least one article;

a frame structure pivotably mounted to the index, the frame structure being operably configured to inhibit removal of the at least one article from the at least one index when at least one portion of the frame structure is in a first position relative to the index, the frame structure being further operably configured to provide support to the index in a raised position when the at least one portion of the frame structure is in one of a plurality of possible second positions;

structure for rotatably mounting the at least one index within the at least one case section, including apertures disposed in opposing ends of the at least one index;

pivot pins operably configured to be insertingly received and retained within the apertures;

structures within the at least one case section defining opposed slots for receiving the pivot pins, and enabling manual removal of the pivot pins from the opposed slots;

each of the pivot pins including a post operably configured to be frictionally received in one of the slots, a stem configured to be received in one of the apertures for enabling the index to be pivoted about the stem, and a head mounted on the stem and configured to be received in the index, and having a width greater than a width of a corresponding aperture for enabling the head to be retained in the index.

* * * * *